US006944907B2

(12) United States Patent
Lynn

(10) Patent No.: US 6,944,907 B2
(45) Date of Patent: Sep. 20, 2005

(54) COLLECTION/DISPENSING SYSTEM WITH IMPROVED MOPPING ASSEMBLY

(76) Inventor: William R. Lynn, 3A 26th Ave., Isle of Palms, SC (US) 29451

( * ) Notice: Subject to any disclaimer, the term of this patent is extended or adjusted under 35 U.S.C. 154(b) by 41 days.

(21) Appl. No.: 10/373,125

(22) Filed: Feb. 24, 2003

(65) Prior Publication Data

US 2003/0126714 A1 Jul. 10, 2003

Related U.S. Application Data

(63) Continuation-in-part of application No. 09/685,837, filed on Oct. 10, 2000, now Pat. No. 6,523,220.

(51) Int. Cl.[7] ..... A47L 13/20; A47L 13/52; A47L 13/59

(52) U.S. Cl. ..... 15/257.1; 15/257.6; 15/261; 15/228; 37/265

(58) Field of Search ..... 15/257.1–257.3, 15/257.6, 257.7, 257.9, 261, 244.1, 228; 294/55, 1.3–1.5; 37/265

(56) References Cited

U.S. PATENT DOCUMENTS 4,161,799 A 7/1979 Sorrells ..... 15/260
5,448,865 A 9/1995 Palmersten ..... 52/309.9
5,983,441 A 11/1999 Williams et al. ..... 15/260
6,233,780 B1 * 5/2001 Mead ..... 15/257.3
6,260,230 B1 7/2001 Hunt ..... 134/6
6,279,195 B1 8/2001 Biggs ..... 15/260

* cited by examiner

*Primary Examiner*—Robert J. Warden, Sr.
*Assistant Examiner*—Shay Balsis
(74) *Attorney, Agent, or Firm*—Davis & Bujold, P.L.L.C.

(57) ABSTRACT

A cleaning system for facilitating cleaning of a desired surface. The cleaning system comprising a base framework supporting a dust pan comprising a ramp area located adjacent a temporary collection receptacle, and the including a pivotal door to facilitate transfer of collected debris. The base framework also supporting a storage bin located adjacent the temporary collection receptacle. An actuation lever is connected to the base framework and operatively coupled to the dust pan to facilitate movement of the dust pan and transfer of any debris, temporarily stored in the temporary collection receptacle, to the storage bin once the pivotal door of the temporary collection receptacle opens.

20 Claims, 13 Drawing Sheets

COLLECTION/DISPENSING SYSTEM WITH IMPROVED MOPPING ASSEMBLY

This is a continuation-in-part of application Ser. No. 09/685,837, filed Oct. 10, 2000, Now U.S. Pat. No. 6,523, 220.

FIELD OF THE INVENTION

The present invention relates to a dispensing/collection system with an improved mopping assembly having drainage channels which facilitate drainage of any absorbed liquid and debris from the mop assembly during a wringing procedure.

BACKGROUND OF THE INVENTION

While there are currently available a number of cleaning systems which facilitate cleaning of a surface, none of the available systems are directed at providing a cleaning system which facilitates removal of substantially all of the absorbed liquids in the debris from the mop head as well as removal of a desired amount of the applied liquid from the surface to be cleaned. Moreover, none of the currently available systems are designed to channel the absorbed liquid and debris from the cleaning pad during a wringing procedure.

In particular, many of the prior art cleaning systems utilize a single fluid or solution which serves both as the cleaning fluid as well as the rinsing fluid. Accordingly, over a relatively short period of time, the cleaning pad, once rinsed in the single fluid or solution, has a tendency to reabsorb some of the removed dirt, grease, wax, oil, and other debris, from in the single cleaning fluid or solution, and redeposits of the removed dirt, grease, wax, oil, and other debris back onto the surface to be cleaned. In addition, it is often difficult for an operator to determine how many wash/rinse cycles of the cleaning pad can occur before the single fluid or solution is discarded and replaced with the new cleaning solution.

A further problem with prior art cleaning systems is that the wringing mechanism is not capable of receiving a separate supply of rinsing solution to rinse the cleaning pad and the wringing mechanism also does not facilitate regulation of the wringing pressure, applied to the mop head, to allow control of the amount of liquid squeezed from or reabsorbed by the cleaning pad 2 upon release of the wringing mechanism—this liquid may thereafter be applied to the surface to be cleaned.

Another associated problem is the fact that it is also difficult for an operator to control the amount of moisture being left on the surface to be cleaned, following mopping of the surface with the cleaning pad 2, due to the erratic pressures applied by various operators while utilizing the wringing mechanism. It is to be appreciated that the amount of moisture remaining of the surface to be cleaned may create a safety concern, especially on a floor or surface which become slippery when wet.

Due to the above noted as well as other associated factors, it is difficult for an operator to clean any desired floor, surface, room, area, etc. in a uniform manner. In particular, depending on the specific operator using the cleaning equipment, various degrees of moisture can be applied or removed from the surface to be cleaned and varying amounts of removed dirt, oil, grease and/or other debris can be removed from the surface to be cleaned during a cleaning process.

Lastly, most conventional mops, sponges, rags, etc., are designed to maximize absorption of fluid, liquid and debris but are not designed to release the absorbed fluid, liquid and other debris during a wringing or cleaning process.

Due to the above noted drawbacks associated with the prior art mopping systems, wringing systems, and/or cleaning systems, the surface to be cleaned is generally re-contaminated, after only one or a couple of rinse cycles of the cleaning pad because the same source of fluid is used both to supply the cleaning fluid to the surface to be cleaned as well as to remove the dirt, grease, wax, oils and other debris from the surface to be cleaned.

SUMMARY OF THE INVENTION

Wherefore, it is an object of the present invention to provide a cleaning/dispensing system which overcomes the above noted drawbacks of the prior art systems.

Another object of the present invention is to provide a mop head which comprises both a non-absorbent material as well as an absorbent material and is provided with a plurality of drainage channels which facilitate drainage of any absorbed liquid and debris from the absorbent material.

A further object of the present invention is to provide a versatile dispensing/cleaning system which facilitates dispensing of a desired cleaning solution to the mop head, during a wringing process, and also facilitates collection of the liquid and debris, wrung from the mop head during the wringing process, in a collection container to facilitate re-use of the collected liquid.

Yet another object of the present invention is to filter the liquid, squeezed from the cleaning pad during the wringing process, prior to collecting the same in the collection container, to facilitate recycling and reuse of the squeezed and collected liquid.

A still further object of the present invention is to rigidly support the absorbent material, via a support structure of the mopping assembly, to facilitate application of a desired contact pressure of the absorbent material, against the surface to be cleaned, as the absorbent material engages with the surface to be cleaned to maximize the cleaning thereof.

A further object of the present invention is to provide a dispensing/cleansing system which is relatively compact and can be readily utilized by a single operator.

Another object of the invention is to provide two separate containers, a first container for housing a cleaning solution and a second container for housing liquid and debris removed from the surface to be cleaned separately from the cleaning solution to minimize, as much as possible, re-contamination of the surface being cleaned.

Yet another object of the present invention is to provide a mechanism for controlling a flow rate of the cleaning solution supplied to the wringing mechanism, during the rinse procedure, to more effectively remove dirt, grease, oil, wax and other debris from the cleaning pad during the wringing procedure.

A further object of the present invention is to provide a mechanism for filtering of the liquid, collected during the wringing process of the mop head, to adequately clean that liquid and facilitate reuse of the collected liquid for further cleaning of the surface to be cleaned or rinsing of the cleaning pad during the rinse procedure.

Still another object of the present invention is to provide a pressure control device, for the wringing mechanism, so that the amount of wringing pressure applied to the cleaning pad by an operator, during the wringing process, can be precisely controlled, each time the cleaning pad is wrung, and thereby facilitate improved control of the amount of moisture reapplied to the surface to be cleaned and result in a more uniform cleaning of the surface being cleaned.

Yet another object of the present invention is to provide a mechanism for controlling the entrance location where the cleaning fluid is applied to the cleaning pad, during the wringing procedure, to facilitate maximum cleaning of the cleaning pad during the wringing process.

A further object of the present invention is to design an improved cleaning pad which has an arrangement such that the absorbent material and non-absorbent materials are combined with one another to define a plurality of elongate drainage channels which facilitate drainage of any absorbed liquid and debris from the cleaning pad during the wringing process.

Another object of the present invention is to incorporate desired polymers and prepolymers in the cleaning pad which are specifically design to absorb a maximum amount of liquid from the surface to be cleaned and to readily release this absorbed liquid once a sufficient pressure is applied to the cleaning pad, during the wringing procedure, and thereby facilitate more precise control over the amount of moisture being re-applied and/or removed from the surface being cleaned.

Still another object of the present invention is designed a cleaning pad which has a desired exterior surface texture to facilitate applying a desired scrubbing action to the surface being cleaned.

Yet another object of the present invention is to provide a cleaning system which facilitates leaving additional moisture on the surface to be cleaned, when cleaning during nighttime, for example, to facilitate "deep" cleaning of the surface to be cleaned while also providing a cleaning system which facilitates removing a maximum amount of moisture from the surface being cleaned, when cleaning during daytime, to adequately dry the surface and minimize the possibility of an individual slipping on the surface being cleaned following cleaning.

A further object of the present invention is to provide a wringing system which facilitates control over the amount of liquid and/or debris removed from the cleaning pad to customize the cleaning efficiency of the system.

The present invention also relates to a cleaning system for facilitating cleaning of a desired surface, the cleaning system comprising a base framework supporting a dust pan comprising a ramp area located adjacent a temporary collection receptacle, and including a pivotal door to facilitate transfer of collected debris; the base framework also supporting a storage bin located adjacent the temporary collection receptacle; an actuation lever being connected to the base framework and operatively coupled to the dust pan to facilitate movement of the dust pan and transfer of any debris, temporarily stored in the temporary collection receptacle, to the storage bin once the pivotal door of the temporary collection receptacle opens.

The present invention also relates to a method of facilitating cleaning of a desired surface, the method comprising the steps of supporting a dust pan, comprising a ramp area located adjacent a temporary collection receptacle, on a base framework, and providing the dust pan with a pivotal door to facilitate transfer of collected debris; supporting a storage bin, located adjacent the temporary collection receptacle, on the base framework; connecting an actuation lever to the base framework and operatively coupling the actuation lever to the dust pan to facilitate movement of the dust pan and transfer of any debris, temporarily stored in the temporary collection receptacle, to the storage bin once the pivotal door of the temporary collection receptacle opens.

As used in the appended claims, the term "debris" is intended to mean any kind or type of spilled material, food, liquid, drink, debris and/or other contaminants to be removed from a surface to be cleaned, such as a tile floor, a wooden floor, a linoleum surface, etc.

BRIEF DESCRIPTION OF THE DRAWINGS

The invention will now be described, by way of example, with reference to the accompanying drawings in which.

DESCRIPTION OF THE PREFERRED EMBODIMENTS

Figure 1:
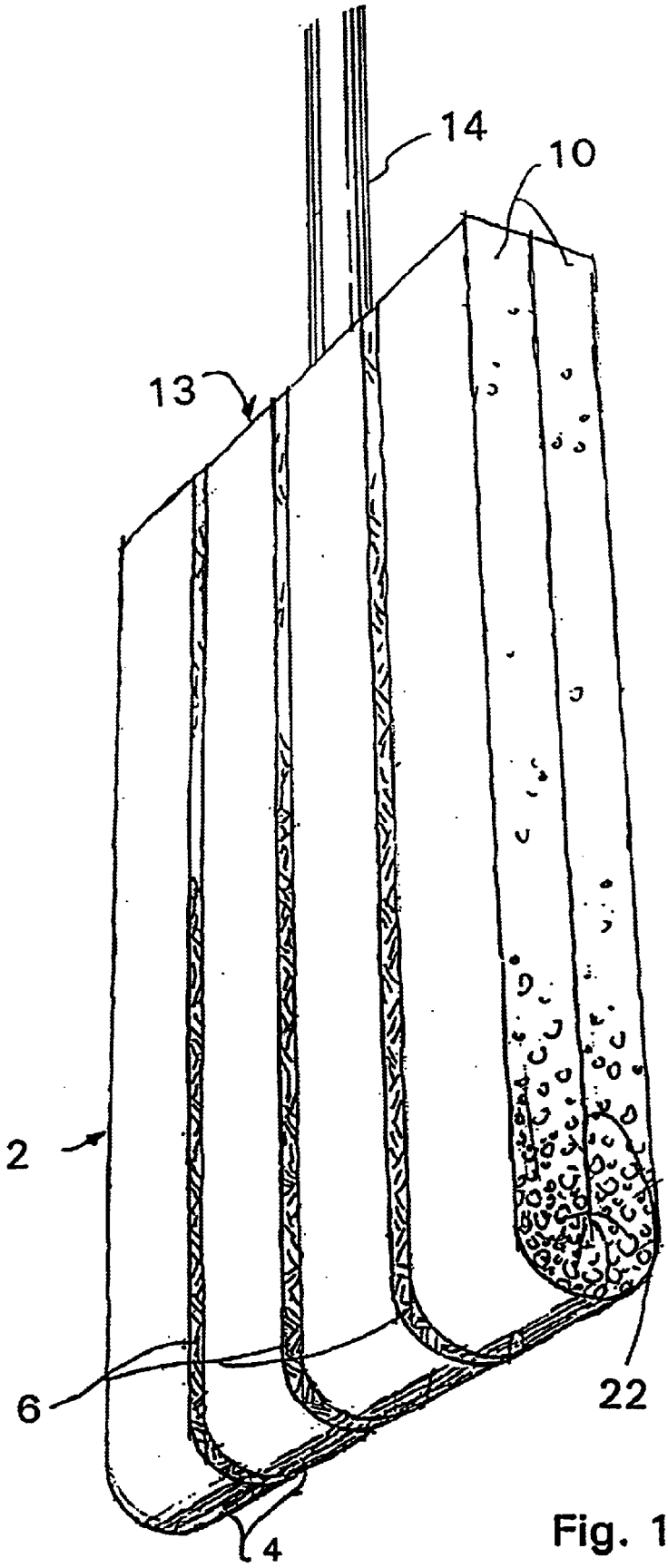
FIG. 1 is a diagrammatic perspective view of an cleaning pad, according to the present invention, shown without a remainder of the associated mopping assembly.
Figure 1A:
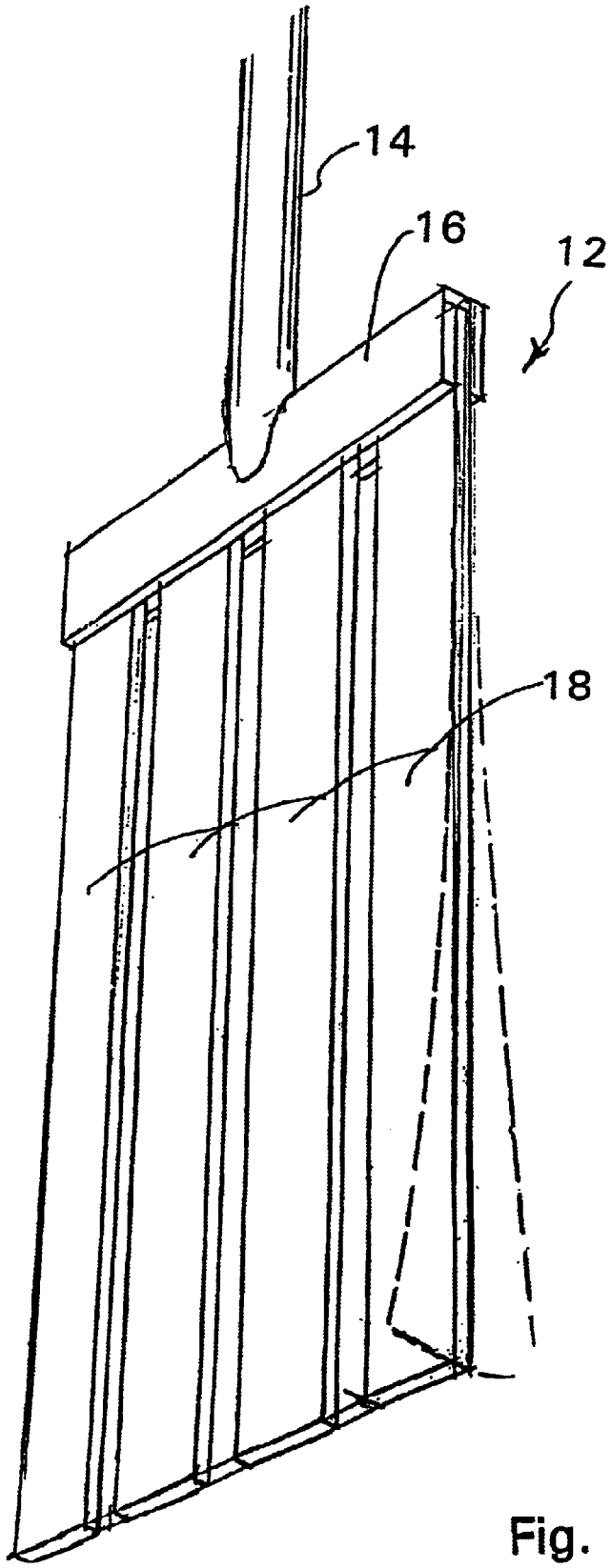
FIG. 1A is a diagrammatic perspective view of mop handle structure for use with the cleaning pad of FIG. 1
Figure 1B:
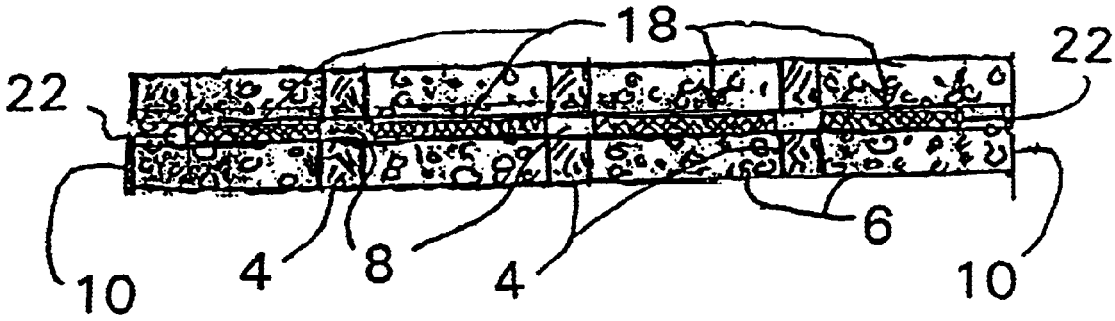
FIG. 1B is a diagrammatic transverse cross section of the cleaning pad of FIG. 1.

Turning first to FIGS. 1–1B, a brief description concerning a mop assembly, according to the present invention, will now be discussed. As can be seen in those Figures, this embodiment of the mop assembly 12 first comprises a cleaning pad 2 which comprises elongate strips of a non-absorbent material 4, such as nylon, polyester, polypropylene, etc., as well as elongate strips of an absorbent material 6, such as cotton, wool, linen, sponges, etc. According to this embodiment, a layer of non-absorbent material 4 is located between adjacent layers of absorbent material 6 and cleaning pad 2 is a generally U-shaped member and has a small opening 13 is defined by space between the adjacent legs of the U-shaped member. The non-absorbent material 4 is permanently secured to the absorbent material 6, e.g. by gluing, adhesion, stitching, etc., so that the strips of non-absorbent material and absorbent material 4, 6 form a the cleaning pad 2.

As can be seen in FIG. 1A, the outwardly facing legs of each opposed exposed absorbent material 6 of the U-shaped cleaning pad 2 is closed by an elongate seam 22 which runs along the entire length of the the U-shaped cleaning pad 2 and permanently connects the opposed legs 10 to one another. The opposite side of the U-shaped cleaning pad 2 is also suitably seamed so as to define an internal pocket for receiving the support fingers 18 of the mopping assembly and preventing the support fingers 18 from being inadvertently dislodged from its desired engagement with the the U-shaped cleaning pad 2 during use of the mopping assembly 12.

The non-absorbent material 4, along with the absorbent material 6 and the support fingers 18, assists with defining a plurality of drainage channels 8. The plurality of drainage channels 8 facilitate drainage of any absorbed liquid and debris, absorbed by the absorbent material 6, into a collection container 42, and a further detailed discussion concerning the same will follow. It is to be appreciated that a sufficient number of drainage channels 8 must be provided to facilitate removal of a sufficient quantity of any absorbed liquid and debris from the absorbent material 6 into collection container 42. When the non-absorbent material 4 and the absorbent material 6 are sufficiently squeezed by a mating pair of pressure rollers, for example, the absorbed liquid and debris will flow laterally along the absorbent material 6, and also laterally along the non-absorbent material 4, into and along the length of the drainage channels 8. Once the absorbed liquid and debris communicates with the drainage channels 8, the absorbed liquid and debris can readily flow out of the aperture at the end of each drainage channels 8 into or toward the collection container 42 where the absorbed liquid and debris are collected for recycling or proper disposal. The drainage channels 8 increase the removal speed and rate of transferring the absorbed liquid and debris from the absorbent material 6 to the collection container 42.

The inventor has determined that unless a sufficient amount of drainage channels 8 are provided to channel any absorbed liquid and debris away from the absorbent material 6 into a collection container 42, prior to allowing the absorbent material 6 to re-expand, the absorbent material 6 will not be as sufficiently rinsed or dried and thus a greater amount of the absorbed liquid and debris may tend to be redeposited back on a surface being cleaned during the next cleaning operation of the mopping assembly 12. However, in the event that a sufficient amount of drainage channels 8 are provided and if sufficient squeezing pressure is applied to the non-absorbent material 4 and the absorbent material 6, a majority of the absorbed liquid and debris can be readily removed from the absorbent material 6 so that the absorbent material 6, following a squeezing process, is readily able to recollect additional liquid and debris from the surface to be cleaned S upon a further pass of the cleaning pad 2 over the surface. A further details description concerning the squeezing process will follow.

The drainage channels 8 each preferably have a cross-section area of about 0.25 square inch, and more preferably have an area of about a 0.04 to 0.08 square inch.

The mopping assembly 12 further comprises a handle 14 having a handle grip (not shown) at a remote free end thereof and a T-shaped head 16 located at the opposite end thereof. A plurality of rigid support fingers 18 each have one end thereof connected to and supported by the T-shaped head 16 while the opposed end of each of the support fingers 18 extends along a longitudinal axis A of the mopping assembly 12. In order to attached the U-shaped cleaning pad 2 to the mopping assembly 12, the support fingers 18 pass through the opening 13 and slide along the inner surface of the U-shaped cleaning pad 2. The support fingers 18 are located to provide rigidity to the cleaning pad 2, especially the absorbent material 6, during use of the the mopping assembly 12.

As can be seen in FIG. 1B, the plurality of drainage channels 8 are defined by a pair of adjacent support fingers 18 as well as overlapped sections of the non-absorbent material 4. These drainage channels 8 facilitate release and channeling of any absorbed liquid and debris from the absorbent material 6 out through the aperture into a desired collection container 42, and a further detailed discussion concerning the same will follow.

As can be seen in FIG. 1A, four support fingers 14 are provided and each one of the support fingers 18, as can be seen in FIG. 1B, is sandwiched between overlapped portions of the absorbent material 6. It is to be appreciated that the number of support fingers 18 can vary from application to application, as would be apparent to those skilled in this art. The support fingers 18 render the U-shaped cleaning pad 2 more rigid and facilitate applying a sufficient cleaning pressure of the absorbent material 6 against the surface to be cleaned S so that the absorbent material 6 can provide a sufficient abrasive contact pressure to the surface to be cleaned S as well as remove dirt, grease, wax, oil, and other debris from the surface to be cleaned S.

Figure 2:
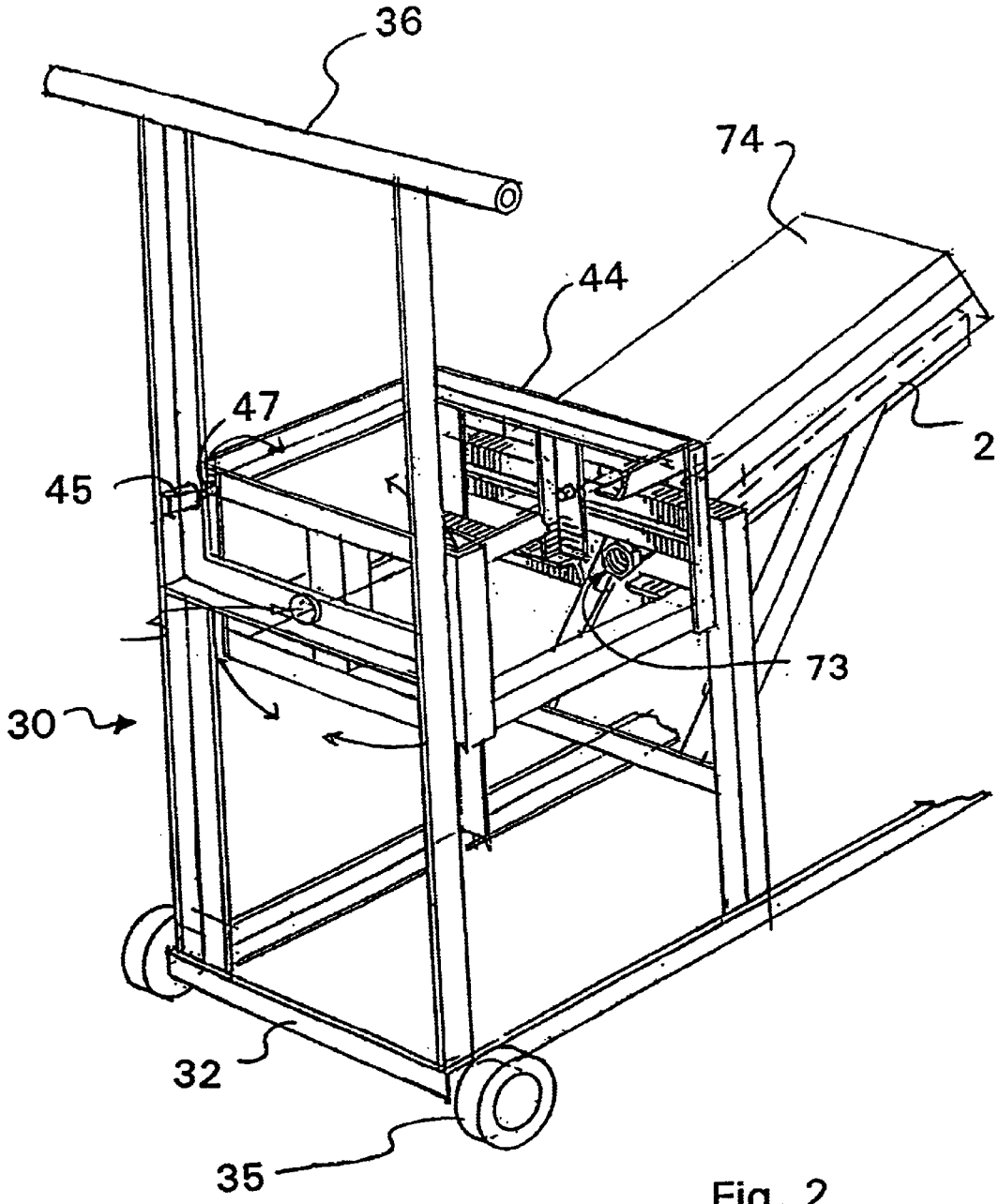
FIG. 2 is a diagrammatic partial perspective view showing a support structure for a collection/dispensing system according to the present invention.
Figure 3:
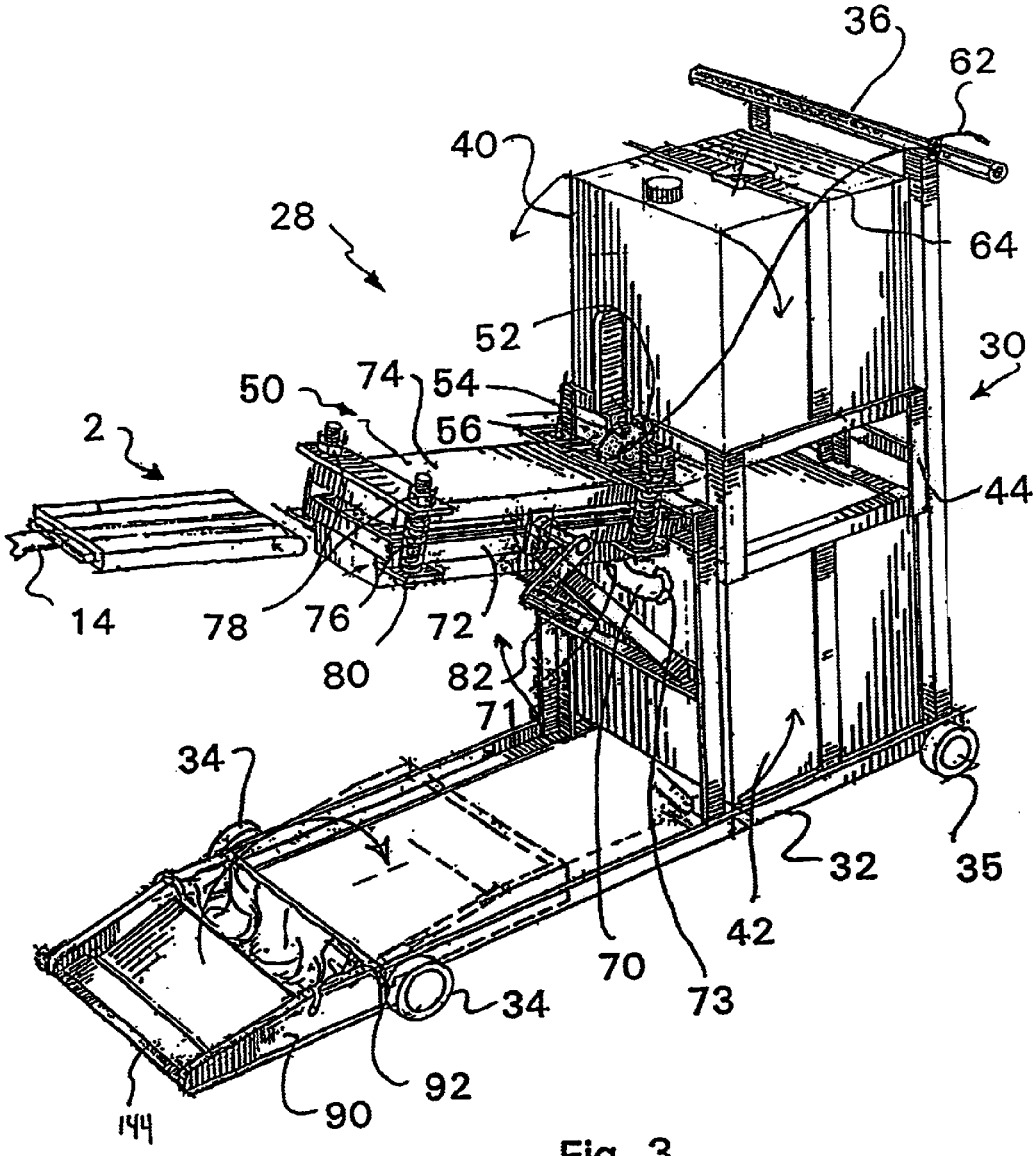
FIG. 3 is a diagrammatic perspective view showing the additional components, attached to support structure, to form the collection/dispensing system according to the present invention.

With reference now to FIGS. 2 and 3, a collection system, for use with the mopping assembly, according to the present invention, will now be discussed in detail. As can be seen in these Figures, the dispensing/collection system 28 generally comprises a support structure 30 which has a base framework 32 for supporting the various components of the dispensing/collection system 28 of the present invention. The entire dispensing/collection system 28 is supported by a front set 34 and a rear set of rotatable rollers or wheels 35 which facilitate rolling motion of the dispensing/collection system 28 along a desired surface. According to a preferred form of the present invention, at least the front pair of the wheels 34 are pivotable or steerable to facilitate maneuvering of the dispensing/collection system 28 during operation.

The base framework 32 supports a transverse handle 36 which is provided to facilitate maneuvering of the dispensing/collection system 28 by an operator. The transverse handle 36 is located so that the operator can readily grab the handle 36 with his or her hands and steer the dispensing/collection system 28 as desired.

The dispensing/collection system 28 further comprises a dispensing container 40 and a collection container 42. The dispensing container 40 and the collection container 42 are both attached to a central framework 44 which is pivotably connected to the remainder of the base framework 32 of the dispensing/collection 28 preferably by a bearing (not shown) to facilitate rotation of the central framework 44. A releasable latch mechanism 45, or some other known conventional releasable locking arrangement, is provided for locking the central framework 44 to the remained of the base framework 32 to preventing undesired rotation of the central framework 44. The releasable latch mechanism 45 is a spring biased pin that is supported by the base framework 32 and a remote end of the pin engages with a hole or recess 47 formed in the central framework 44. Such engagement prevents undesired rotation of the central framework 44 relative to the base framework 32.

The central framework 44 of the dispensing/collection system 28 facilitates simultaneous rotation, over an angle of 180°, of the dispensing container 40 and the collection container 42 so that the two containers reverse positions with one another. That is, following rotation, the dispensing container 40 occupies of the position previously occupied by the collection container 42 and the collection container 42 occupies of the position previously occupied by the dispensing container 40. Prior to being able to rotate the central framework 44, the releasable latch mechanism 45 must be disengaged from the hole or recess 47 of the central framework 44.

According to a preferred form of the invention, a collection fluid will be added to the dispensing container 40 and used to supply a cleaning fluid to the wringer mechanism 50 which is used to clean the mopping assembly. A first end 52 of the supply conduit 54 is connected to an outlet of the dispensing container 40, in a fluid tight manner, while an opposite second end 56 of the supply conduit 54 is connected to an upper region of the wringer mechanism 50, in a fluid tight manner. The connection of the supply conduit 54 to the dispensing container 40 is a releasable connection to facilitate rotation so that the dispensing container 40 can occupy the position of the collection container 42, and vice versa. A valve 60 (not shown in detail) is located in the supply conduit 54 to control the flow rate of the cleaning fluid from the dispensing container 40 to the wringer mechanism 50. A conventional handbrake 62, connected to the flow valve 60 by conventional cabling 64, is utilized to facilitate remote actuation of the flow valve 60 located in the supply conduit 54 by an operator, when desired. That is, when the operator depresses the handbrake 62 which actuates the cable 64 which, in turn, biases the valve 60 into an open position, in a conventional manner, to allow the flow of liquid along the supply conduit 54 to the wringing mechanism 50. When the operator releases the handbrake 62, the cable 64 discontinues actuation of the valve 60 and thus the valve 60 returns to its normally closed, spring biased position which prevents the flow of liquid along the supply conduit 54 past the valve 60. This valve/hand brake arrangement allows an operator to remotely control of the flow valve 60 of liquid along the supply conduit 54 to the wringing mechanism 50.

The dirty fluid resulting from cleaning of the mopping assembly 12, containing the removed dirt, grease, wax, oil, and other debris, is then channeled by a drainage conduit 70 into the collection container 42 but, prior to entering the collection container 42, passes through a filter 81 which filters the dirty fluid prior to depositing that fluid in the collection container 42. Once the dispensing container 40 has completely substantially dispensed its entire fluid contents, the releasable latch mechanism 45 is actuated or operated to allow unrestricted rotation of the central framework 44 so as to simultaneously rotate 180° both the dispensing container 40 and the collection container 42 whereby the collection container 42 is now located adjacent the handle 36 while the dispensing container is now located adjacent the rear set of rotatable rollers or wheels 35 of the dispensing/collection system 28. Thereafter, the fluid contained within the collection container 42 is utilized to supply a rinsing/cleaning fluid to the wringer mechanism 50 and the supplied fluid is then wrung from the mopping assembly 12, during a wringing process, and filtered, by the filter 81, prior to being channeled by the drainage conduit 70 into the dispensing container 40—which is now functioning as the collection container 42. This procedure is repeated, as necessary or desired, until it is determined, by the operator, that the fluid of the dispensing/collection system 28 is sufficiently dirty or contaminated to justify disposal of the same and replenishing the dispensing/collection system 28 with a fresh supply of cleaning fluid.

The wringer mechanism 50, of the dispensing/collection system 28, facilitates squeezing the cleaning pad 2 of the mopping assembly 12 to remove a substantial portion of the absorbed dirt, grease, wax, oil, and other debris from the absorbent material 6 and the non-absorbent material 4. The wringer mechanism 50 comprises a pair of opposed pressure plates 72, 74 which are spaced from one another by a sufficient distance to allow the cleaning pad 2 of the mopping assembly 12 to be readily received therebetween, e.g., the pair of opposed pressure plates 72, 74 are spaced apart from one another by a distance of between at least about 2 inches or so to about 8–9 inches or so. One of the opposed pressure plates 72 is preferable fixedly attached to the base framework 32 while the other pressure plate 74 is movable or pivotal relative to the fixed pressure plate 72. Preferably pair of pressure plates 72, 74 are spring biased away from one another by a plurality of springs 76, e.g., four springs. As can be seen in FIG. 3 of the drawings, four nuts 78 and associated bolts 80 are utilized to couple the two opposed plates 72, 74 to one another and allow limited relative movement to and from movement therebetween. The springs 76 apply a biasing force to maintain the pair of opposed pressure plates 72, 74 in a desired spaced apart relationship from one another to facilitate receipt of the cleaning pad 2 during the wringing process.

The wringer mechanism 50 includes a hand crank mechanism 82 which is designed to be easily turned by the operator and to facilitate applying a desired biasing force, e.g., by a conventional rack and pinion arrangement (not shown), to at least one of the opposed pressure plates 72, 74 to force the movable plate 74 toward the fixed plate 72 and apply a sufficient squeezing force to the cleaning pad 2 of the mopping assembly 12 when located between the two opposed plates 72, 74. This relative motion of the opposed pressure plates 72, 74 applies a squeezing pressure to the cleaning pad 2 of the mop assembly 12 and the absorbed dirt, grease, wax, oil, and other debris are squeezed from the cleaning pad 2 and flow, via gravity, along the plurality of drainage openings or passages (not shown) provided in the lower fixed pressure plate 72.

Figure 7:
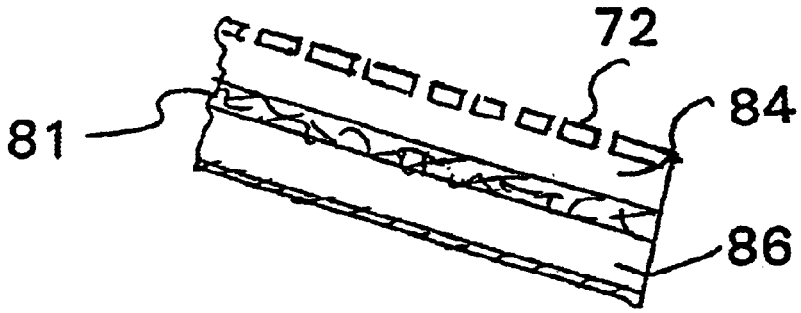
FIG. 7 is a partial diagrammatic cross sectional view showing the separation chamber of the wringing mechanism.

The first pressure plate 72, of the wringer mechanism 50, is preferably a perforated plate (see FIG. 7) having a plurality of holes, apertures or passages therein which facilitate drainage of any removed liquid, dirt, grease, wax, oil, and other debris from the cleaning pad 2 into a lower region of the wringer mechanism 50. A planar filter 81 divides a separation chamber into an upper chamber 84 and a lower chamber 86. The removed liquid, dirt, grease, wax, oil, and other debris which passes through the perforated plate 72 flows into the upper chamber 84 and is deposited on the filter 81 and the solids and other debris which can not pass through the filter 81 collects on the top surface of the filter 81. The fluid which passes through the filter 81 is at least partially cleaned and then partially cleaned fluid collects in the lower chamber. The partially cleaned and filtered fluid then flows, via gravity, along the drainage conduit 70 into the collection container 42 where this fluid is finally collected and stored for later use or disposal.

A first end 71 of the drainage conduit 70 is connected to an outlet of the lower chamber of the wringer mechanism 50, in a fluid tight manner, while an opposite second end 73 of the drainage conduit 70 is connected to an inlet of the collection container 42, in a fluid tight manner. The connection of the drainage conduit 70 to the collection container 42 is a releasable connection to facilitate rotation so that the collection container 42 can occupy the position of the dispensing container 40, and vice versa.

When rotation of the central framework 44 is desired, to reverse the positions of the dispensing container 40 with the collection container 42 or vice versa, the second end 73 of the drainage conduit 70 is disconnected the collection container 42 and the first end 52 of the supply conduit 54 is disconnected the dispensing container 40. Thereafter, the releasable latch mechanism 45 is disengaged from the hole or recess 47 in the central framework 44 and the positions of the dispensing container 40 with the collection container 42 are switched or reversed with one another. Next, the releasable latch mechanism 45 again re-engages with a second hole or recess 47 formed in the central framework 44 to prevent further relative rotation of the switched containers. Finally, the second end 73 of the drainage conduit 70 is then connected with the dispensing container 40 while the first end 52 of the supply conduit 54 is connected to the collection container 42. Thereafter, the dispensing/collection system 28 can be operated as described above.

When it is necessary to completely replace the water, any fluid contained in either the dispensing container 40 and/or the collection container 42 is discarded into a drain or some other suitable collection device in a conventional manner. If desired, both the dispensing container and the collection container 42 can be rinsed or flushed with fluid prior to adding a new supply of cleaning fluid to the dispensing container 40. To facilitate cleaning of the dispensing container 40 and the collection container 42, both containers can either be completely removed from the central framework 44 or a small conventional valve can be provided in the lower portion of each one of those containers 40, 42 to facilitate drainage of any fluid still remaining therein. As such teaching is conventional and well known in the art, a further detailed description concerning the same is not provided.

If desired, a front portion of the base frame can support a pivotable dust pan 90, as can be seen in FIG. 3. The dust pan 90 is pivoted along the leading edge of the support structure 30 by a conventional hinge 92. As a result of such pivoted connection, the dust pan 92 has both a storage or stowed position, shown in dashed lines, as well as an in use position, shown in solid lines, where a leading edge of the dust pan 90 is in engagement with the surface to be cleaned to allow any solid materials, which are on the surface to be cleaned, to be readily swept or mopped up an inclined ramp of the dust pan into a temporary collection receptacle thereof. The leading edge of the dust pan 90 is typically provided with a thin rubber elongate strip which provides a good sealing engagement between the leading edge of the dust pan and the surface to be cleaned. Such contact ensures that a majority of the liquid and other debris, to be removed from the surface to be cleaned, is conveyed along the inclined ramp of the dust pan 90 into the temporary collection receptacle. If desired, the dust pan 90 can be releasably attached to the base framework 32, rather than being permanently attached thereto, to facilitate emptying of the dust pan 90, when desired.

An important aspect of the present invention is to utilize a conventional super-absorbent polymer as the absorbent material 6. The super-absorbent polymer can be engineered to release a desired amount of absorbed moisture from the cleaning pad 2 when subjected to a desired squeezing pressure. For example, if an operator cleaning a floor or other surface desires to ensure that the floor is substantially dry immediately following cleaning, the operator would utilize a cleaning pad which releases substantially all of the absorbed moisture (e.g., release about 95 percent of the absorbed moisture) when subjected to a pressure of about 20 pounds. Alternatively, a different cleaning pad 2 may be utilized at night when the operator cleaning the desired floor or other surface wishes to leave a residual amount of moisture on the floor to facilitate dissolving any remaining or hard to remove grease, soil, dirt, stain, etc., which is on the surface to be cleaned S. In such instance, a super-absorbent polymer which is designed to release only a small amount of absorbed moisture (e.g. release only about 30 percent of the absorbed moisture) when subjected to a pressure of about 20 pounds utilized so that additional moisture is conveyed to and deposited on the surface to be cleaned S. Once the additional moisture has been allowed to react and dissolve any remaining grease, dirt, soil, etc., on the surface to be cleaned S, that surface can then be clean again with a new cleaning pad 2, e.g., a cleaning pad 2 which releases substantially all of the absorbed moisture (e.g., release about 95 percent of the absorbed moisture) when subjected to a pressure of about 20 pounds, to ensure that the floor is substantially dry immediately following cleaning.

Figure 4:
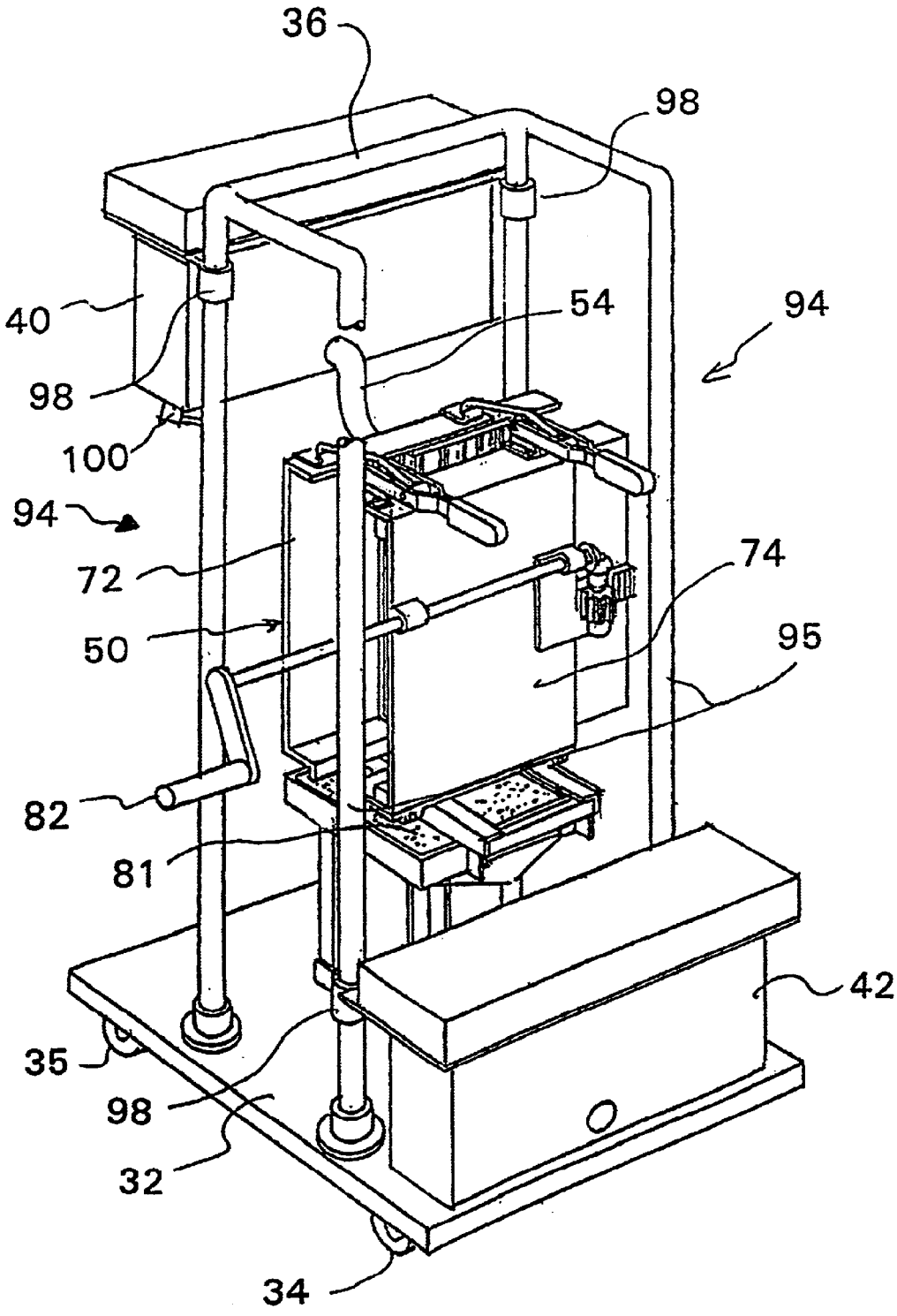
FIG. 4 is a diagrammatic perspective view showing a second embodiment of the collection/dispensing system according to the present invention.
Figure 5:
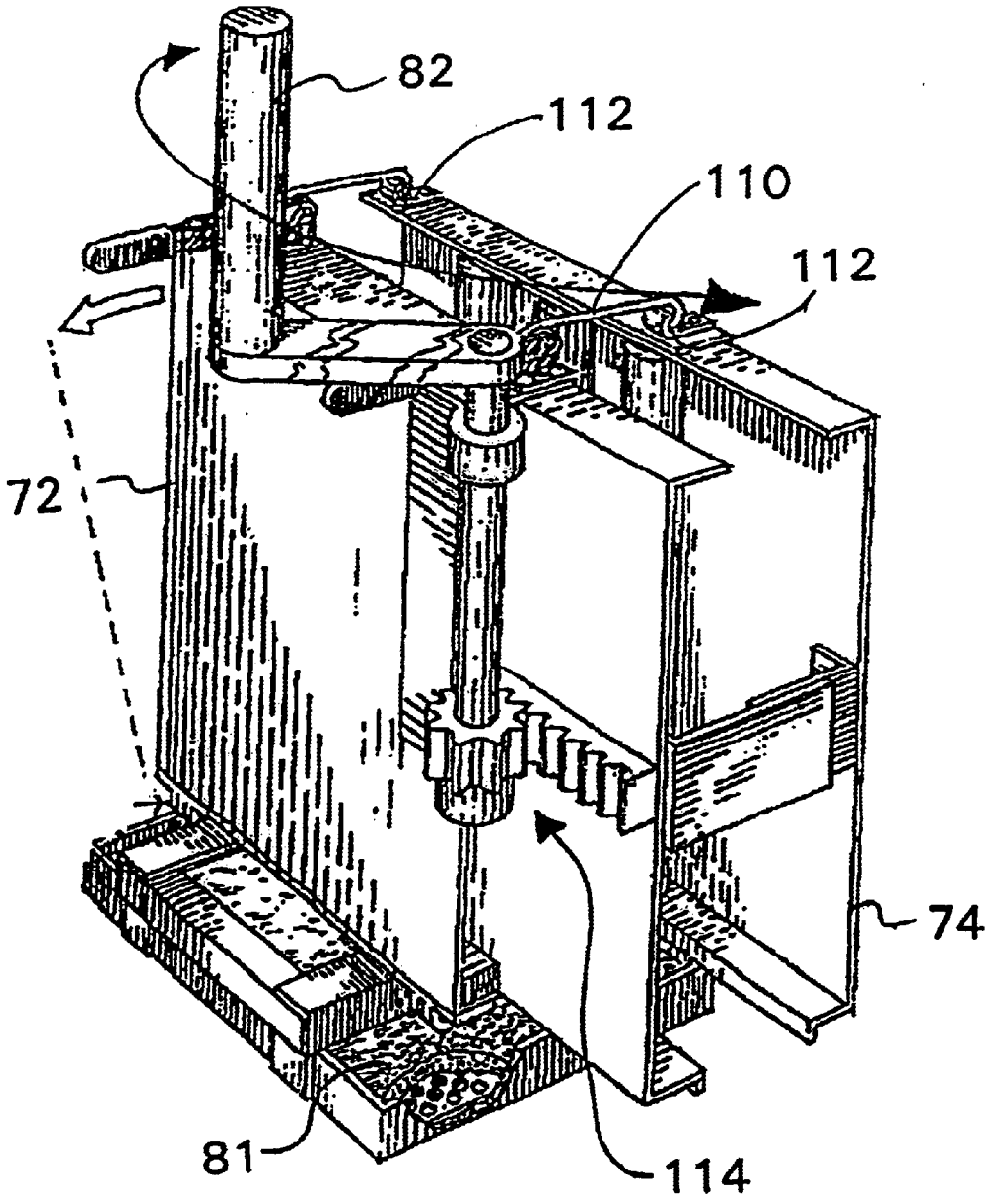
FIG. 5 is a diagrammatic perspective view showing a second embodiment of the wringing mechanism to the present invention.
Figure 6:
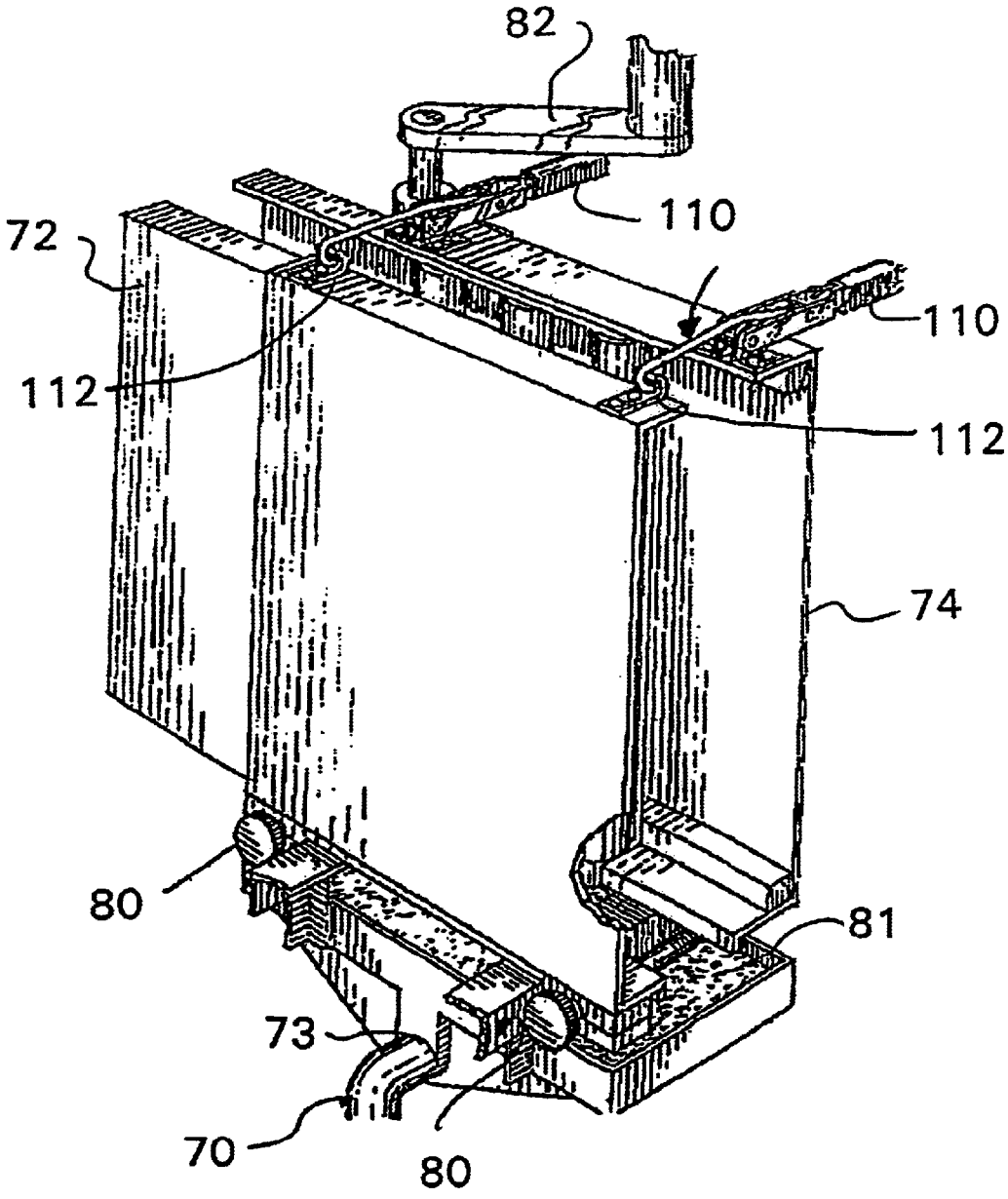
FIG. 6 is a diagrammatic perspective view showing on opposite side of the wringing mechanism of FIG. 5.

With reference now to FIGS. 4–6, a second embodiment of the the dispensing/collection system 28, according to the present invention, will now be discussed. As many of the same components are similar to those of the first embodiment, only a comprehensive discussion concerning the variations between the second embodiment and the first embodiment will be discussed in detail.

As with the first embodiment, a base framework 32 supports the cleaning/dispensing system 28. A pair of front and rear rollers or wheels 34, 35 as well as a transverse handle 36 facilitate manipulation of the cleaning/dispensing system 28 in similar manner to the first embodiment. In addition, a dust pan (not shown) may, if desired, be provided on the leading edge of the cleaning/dispensing system 28 to facilitate mopping of solids, materials, waste and debris, as with the first embodiment.

The major difference between this embodiment and the first embodiment is the arrangement of the dispensing container 40 and the collection container 42. According to this embodiment, the central framework 44 is eliminated and replaced with a pair of opposed vertical support members 94 comprising a pair of vertically extending shafts or poles 95. The wringer mechanism 50 is located centrally with respect to the base framework 32 and one of the pair of vertical support members 94 is positioned on a first side of the wringer mechanism 50 while the other of the pair of vertical support members 94 is located on the opposite side of the wringer mechanism 50. A first one of the pair of vertical support members 94 supports the dispensing container 40 while the second one of the vertical support members 94 supports the collection container 42. Each one of the containers 40, 42 is provided with a pair of cylindrical sleeves 98, with one sleeve being located on opposite sides of each one of each respective containers. Each one of the sleeves 98 encases and surrounds one of the shafts or poles 95 of the vertical support members 94. If desired, the sleeves 98 may be provided with roller bearings, or some other anti-friction element or surface, to assist with relative sliding motion between sleeve and the shafts or poles 95 to allow relatively unrestrictive to and fro movement of the container 40 or 42 along the vertical support members 94. A lower portion of each one of the containers is provided with a retractable pin 100, or some other conventional latching or locking mechanism, which engages with an aperture (not shown) provided in a vertically upper region of the shafts or poles 95, remote from the base framework 32, to lock one of the containers 40 or 42 in an elevated position. When the operator retracts the pin from engagement with the aperture of the support shaft, this will facilitate lowering of the respective container 40 or 42 to a lowered position, while the opposite container 42 or 40 is raised from its lowered position to an elevated position. It is to be appreciated that during use, only one of the containers 40 or 42 will be an elevated position while the other container 42 or 40 will be in a lowered position.

The dispensing container 40 is initially coupled to an supply inlet, located in the upper region of the wringer mechanism 50, by a supply conduit 54 to facilitate conveying of the cleaning fluid from the dispensing container 40 to the wringing mechanism 50 to assist with cleaning, flushing, rinsing and/or wringing the cleaning pad 2 of the mopping assembly 12 when desired. Preferably, a valve is located somewhere along the supply conduit 54 to facilitate flow control of the cleaning, flushing and/or rinsing fluid into the wringing mechanism 50 when desired by the operator. A lower region of the wringing mechanism 50 is provided with a discharge outlet which communicates, via a drainage conduit 70, with an inlet of the collection container 42. Both the supply conduit 54 and the drainage conduit 70 as well as the supply inlet and the discharge outlet of the wringing mechanism 50, all have mating thread sizes so that either one of the supply or drainage conduits 54 or 70 can be coupled to either one of the supply inlet or discharge outlet of the wringing mechanism 50 to facilitate either conveying fluid to or removing fluid from the wringing mechanism 50, depending upon the location of the respective container 40 or 42. For proper operation of the cleaning/dispensing system 28, the elevated container 40 or 42 is coupled to the supply inlet of the wringing mechanism 50 while the lowered container 42 or 40 is coupled to the discharge outlet of the wringing mechanism 50. Both the supply and drainage conduits 54, 70 are sufficiently flexible and each have a sufficient length to facilitate connection to either one of the two containers 40 or 42.

As with the previous embodiment, the wringing mechanism 50 has a separation chamber which has a planar filter which separates the separation chamber into an upper chamber and a lower chamber (not shown). The lower chamber communicates with the discharge outlet of the wringing mechanism 50 to convey fluid components to the collection container 42 while the upper chamber collects the solid debris and other waste resulting from the use of the cleaning/dispensing system 28.

It is to be appreciated that it is occasionally necessary to change the fluid of the cleaning/dispensing system 28 and thus an operator should periodically check the filter 81 and empty the fluid from the upper chamber when required. Such routine maintenance maximizes recycling and reuse of the fluid during operation of the cleaning/dispensing system 28.

During use of this embodiment of the cleaning/dispensing system 28, the operator will generally vertically lower the cleaning pad 2 of the mopping assembly 12 into the opening of the wringing mechanism 50 formed in the top region of the wringing mechanism 50 until the T-shaped head 16 is at least partially received within the wringing mechanism 50. Thereafter, the operator will operate the crank mechanism to force the first and second pressure plates 72, 74 toward one another and apply a sufficient wringing or squeezing pressure to the mop head 16. Due to such motion, the first and second pressure plates 72, 74 squeeze or wring out a desired quantity of the absorbed dirt, liquid, grease, oil and/or debris which has been collected, by use of the mopping assembly 12 on the surface being cleaned.

While the wringing mechanism 50 is activated by the operator, the operator will intermittently supply washing, cleansing, and/or rinsing fluid from dispensing container 40 to the wringing mechanism 50, via actuation of the hand brake 62 coupled to the valve 60 at the supply inlet of the wringing mechanism 50. This fluid assists with cleaning, rinsing or wringing out any residual debris, oil, grease, etc., contained or remaining in the cleaning pad 2. If desired, the operator can wring and/or rinse the cleaning pad 2 a desired number of time or cycles to ensure that the cleaning pad 2 is sufficiently cleaned for its next cleaning operation. Once the cleaning pad 2 has be sufficiently wrung, the operator will reverse operation of the crank mechanism 82 and such action will allow the springs to again bias the first and second pressure plates 72, 74 away from one another and thereby facilitate removal of the cleaning pad 2 of the mopping assembly 12 from the access opening of the wringing mechanism 50. Once the mopping assembly 12 has been adequately cleaned, the operation can then proceed with a further cleaning of the surface to be cleaned.

It is to be appreciated that either one or both of the container 40 or 42 can be provided with a small drainage duct, formed in a lower most region of the container 40 or 42 coupled to a lower portion thereof, while the opposite end thereof is coupled to either a conventional spray trigger mechanism to allow the operator to dispense additional cleaning fluid onto a desired or heavily soiled area of the surface being cleaned which may require additional cleaning fluid. Alternatively, a portable spray bottle (not shown), containing a desired quantity of a suitable cleaning fluid, may be supported by a conventional tray attached to the dispensing/cleaning system 28 of the present invention for dispensing additional cleaning fluid onto a desired or heavily soiled area of the surface being cleaned.

The wringing mechanism 50, according to this embodiment, comprises a first pressure plate 72 and a second pressure plate 74. The first pressure plate 72 supports a pair of levers 110 while the second pressure plate 74 supports a pair of latches 112. The levers 110, when engaged with the latches 112, facilitate drawing the first and second pressure plates toward one another to apply of biasing pressure on the cleaning pad 2, when located therebetween. A conventional hand crank 82 is utilized to operate a rack and pinion arrangement 114 to move the pressure plates 72, 74 to and fro horizontally with respect to the base framework 32. During such to and fro movement, the rollers exert a squeezing pressure on the cleaning pad 2 to apply a sufficient pressure to force the liquid, debris and other materials from the absorbent and non-absorbent material 4,6 and allow that liquid, debris and other materials to flow longitudinal along the drainage channels 8. The squeezed liquid, debris and other materials then falls, via gravity, on the filter 81 where the clean liquid is allowed to pass thereto while the solid debris and other contaminants are collected on a top surface of the filter 81.

The wringing mechanism 50 has a pair of guide tracks (not separately labeled) which allow guiding movement of the first and second plates 72, 74 when they move to and fro via operation of the crank mechanism 82. The free ends of the pressure pads 72, 74 adjacent the levers 110 are allowed to pivot with respect to the guide tracks to form an opening for receiving the cleaning pad 2 therebetween.

Figure 8:
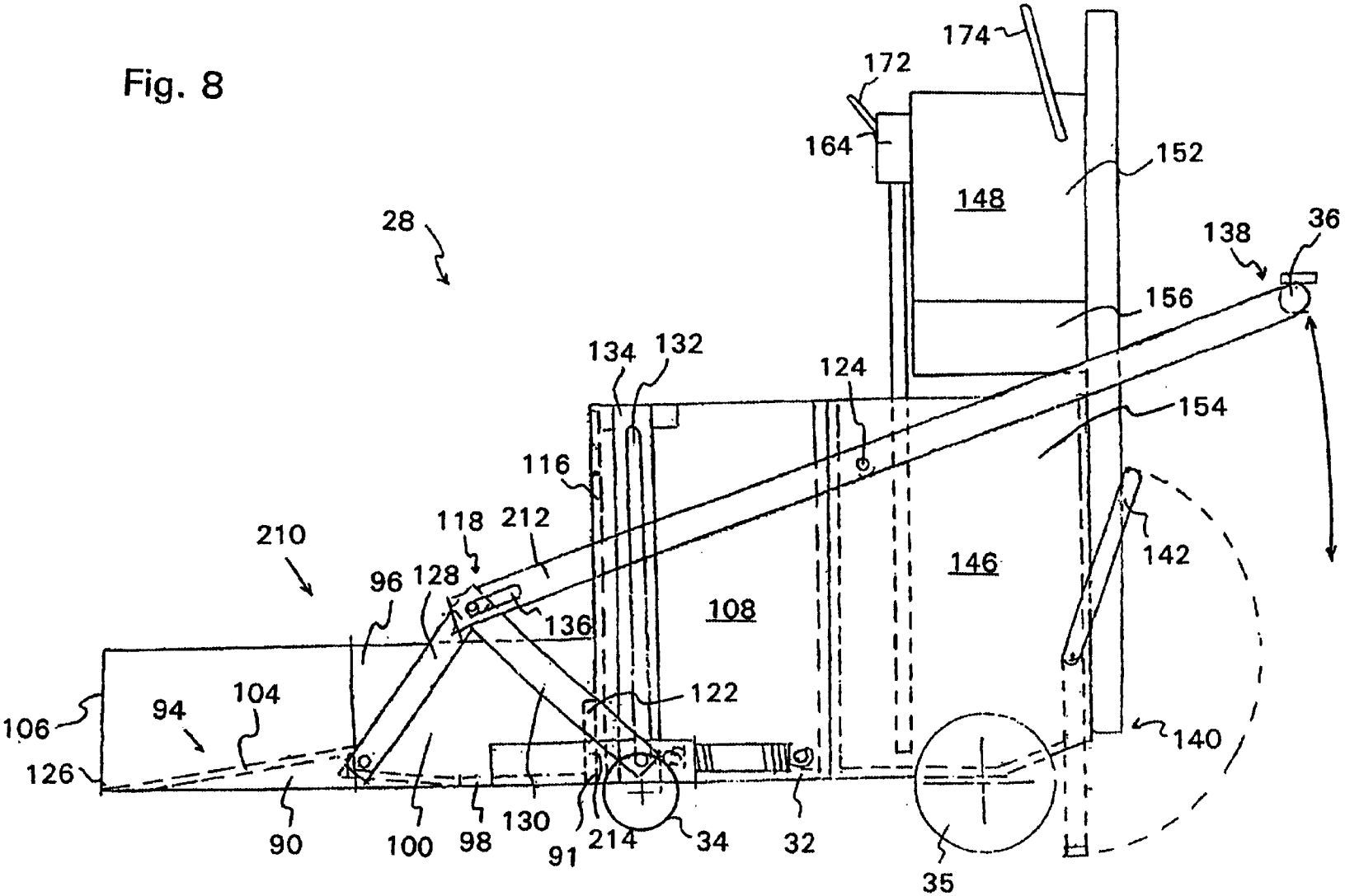
FIG. 8 is a diagrammatic perspective view showing another embodiment the collection/dispensing system according to the present invention.
Figure 9:
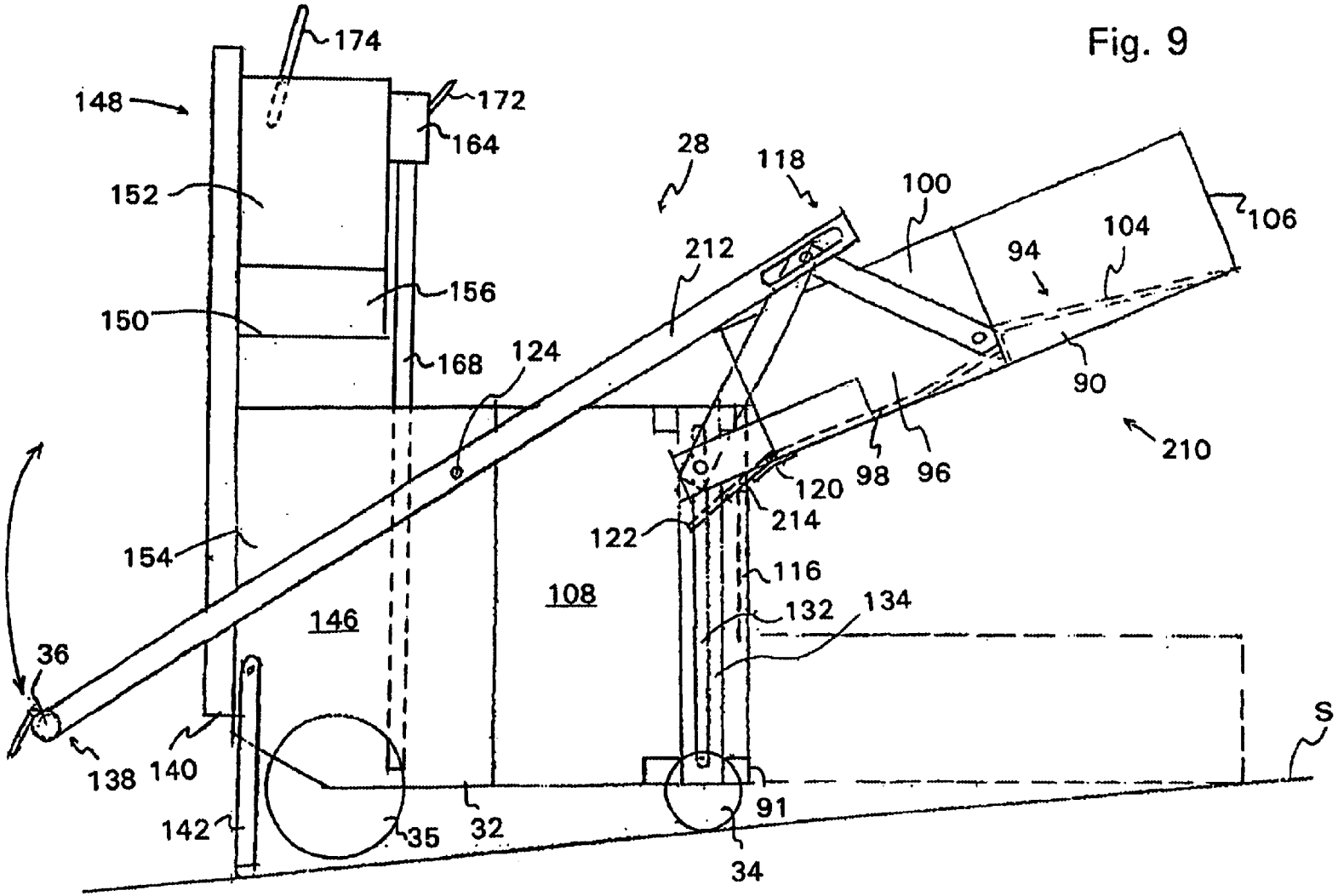
FIG. 9 is a diagrammatic perspective view showing another embodiment the collection/dispensing system according to the present invention.
Figure 10:
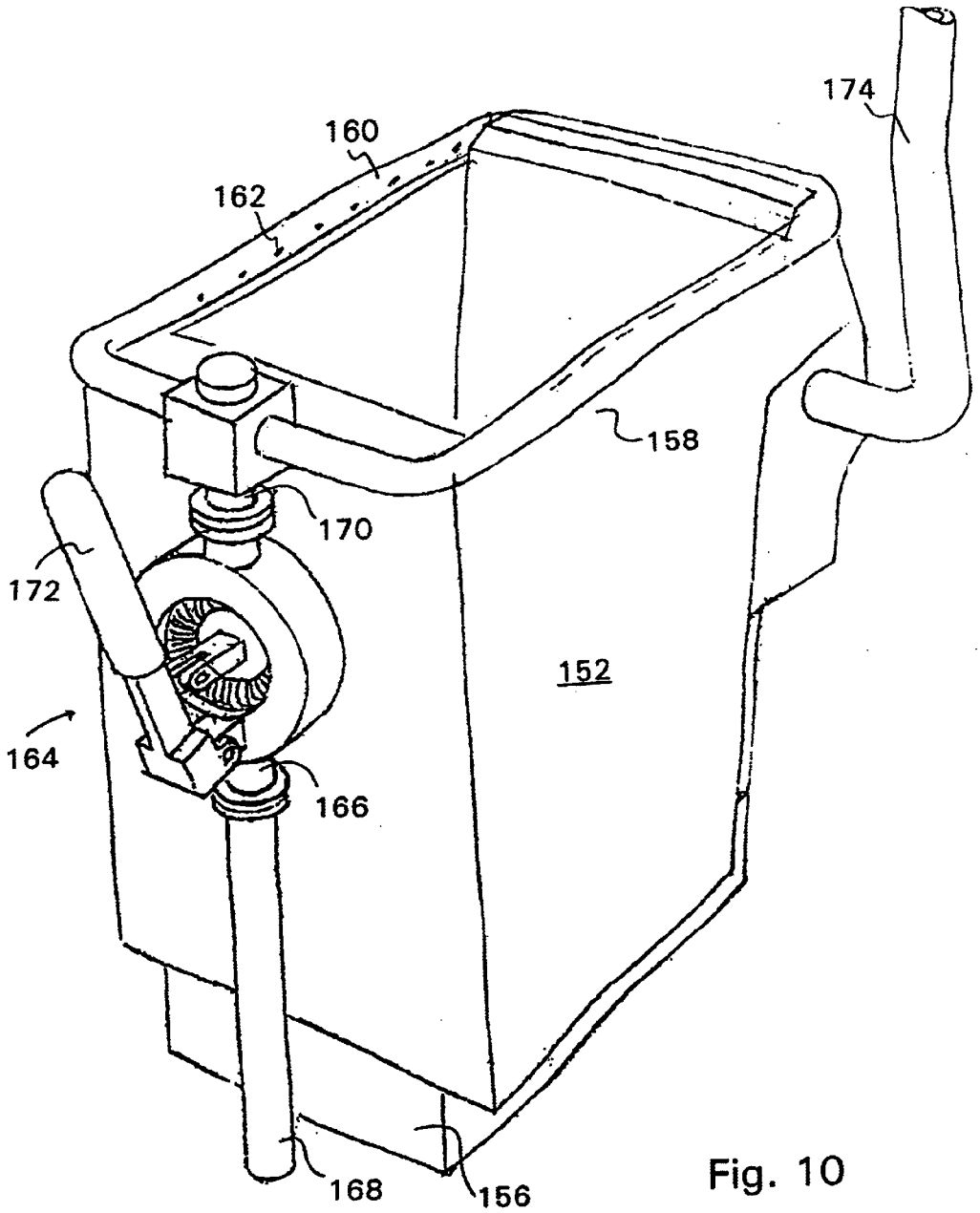
FIG. 10 is a diagrammatic view showing a additional embodiment of the wringing mechanism with a rinsing mechanism.

With reference to FIGS. 8 and 9, diagrammatic side elevational views of a third embodiment of the dispensing/collection system 28 according to the present invention are shown. As a number of elements of this embodiment are similar to those in the previous embodiment, such elements are given the same reference numerals while a detailed discussion is only provided with respect to the new elements of this new embodiment.

As shown in those drawings, the cleaning/dispensing system 28 includes a base framework 32 which is supported by a pair of front wheels 34 and a pair of rear wheels 35. The pair of front wheels 34 may be slightly smaller in size or diameter than the pair of rear wheels 35 in order to maintain the leading end of the cleaning/dispensing system 28 in close proximity to the surface to be cleaned S. Preferably one of the pair of wheels, e.g., the rear pair of wheels 35, is pivotally supported to the cleaning/dispensing system 28 to facilitate steering of the cleaning/dispensing system 28. An upper portion of the base framework 32 includes a transverse handle 36 to facilitate manipulation of the cleaning/dispensing system 28 as desired by an operator.

As with the first embodiment, a dust pan 90 is provided along the leading edge 91 of base framework 32. However, according to this embodiment, the dust pan 90 includes a number of significant modifications from the previous embodiment(s). The dust pan 90, according to this embodiment, generally comprises a ramp area 94 located adjacent a temporary collection receptacle 96. The temporary collection receptacle 96 generally comprises a rectangularly confined area which has a base surface 98 and a pair of opposed side walls 100. A pivotal door 214 is provide opposite to the ramp area 94 to facilitate transfer of the collected spilled food, debris and other contaminants from the temporary collection receptacle 96 and a further discussion concerning the same will follow below. The temporary collection receptacle 96 is suitably sized, e.g., between about 100 to about 1500 cubic inches or so, to facilitate collection and temporary storage of and collected spilled material, food, debris and other contaminants removed from a surface to be cleaned S.

The ramp area 94 includes an inclined surface 104 which forms an angle of between 1° and 15° or so, and more preferably an angle of about 10° or so, with respect to a surface to be cleaned S when the dust pan 90 is in an in use position. The ramp area 94 has a pair of opposed sidewalls which facilitate guiding of the food, debris and other contaminants to be removed from the surface up the ramp into to be cleaned into the temporary collection receptacle 96. The pair of opposed sidewalls may, if desired, taper slightly inward from the leading edge 126 toward the temporary collection receptacle 96 to funnel the food, debris and other contaminants into the temporary collection receptacle 96. It is important that the inclined surface 104 must not have too steep an incline as this will deter collection of liquids into the temporary collection receptacle 96.

A storage bin 108 is located adjacent the temporary collection receptacle 96 of the dust pan 90 and an actuation lever 212 is operatively coupled to the dust pan 90 to elevate the dust pan 90 and facilitate transfer of the collected food, debris and other contaminants from the temporary collection receptacle 96 to the storage bin 108 once a rear pivotal door 214 of the temporary collection receptacle 96 is permitted to open. In the normal lowered position of the dust pan 90, the pivotal door 214 is maintained in abutting engagement with a front sidewall 116 of the storage bin 108 and thus the pivotal door 214 is maintained in its normally vertical closed position. Upon elevation of the dust pan 90, the pivot door is raised above the storage bin 108 and is allow to pivot rearward, due to gravity, into an open position and facilitate transfer of the collected food, debris and other contaminants from the temporary collection receptacle 96 into the storage bin 108. The actuation lever is pivotably connected to the base framework 32, at a central location along its length, with a free end 138 of the actuation lever 212 located adjacent the transverse handle 36 so as to be readily grasped by an operator of the dispensing/collection system 28. When the operator grasps the free end 138 of the actuation lever 212 and moves or rotates the actuation lever 212 (as can be seen by the arrow in FIG. 8), the opposite end 118 of the actuation lever 212 is correspondingly raised. Due to the coupling of the opposite end 118 of the actuation lever 212 to the dust pan 90, the dust pan 90 is also simultaneously raised a corresponding distance relative to the surface to be cleaned S until the dust pan 90 reaches an end of travel position, as shown in FIG. 9. Upon elevating the dust pan 90 with the actuation lever 212, the dust pan 90 is gradually pivoted from a position in which a base surface 98 of the temporary collection receptacle 96 lies substantially parallel to the surface supporting the dispensing/collection system 28 to an inclined position in which the base surface 98 of the temporary collection receptacle 96 is sufficiently inclined with respect to the surface supporting the dispensing/collection system 28 to allow the collected food, debris and other contaminants to be readily transferred to the storage bin 108 as the pivotal door 214 opens.

The pivotal door 214 of the temporary collection receptacle 96 is pivotally attached thereto only along the base surface 98 of the temporary collection receptacle 96 so that once the actuation lever has pivoted the dust pan 90 a sufficient distance above the storage bin 108, the pivoted door is allowed to gradually pivot about its pivot hinge 120 into an open position in which the pivotal door 14 rotates and a free end 122 of the pivotal door 214 extends into an interior of the storage bin 108. Upon the pivotal door 214 completing its rotation, the pivotal door 214 forms a transfer ramp for transferring the collected food, debris and other contaminants from the temporary collection receptacle 96 to the storage bin 108. Once this occurs, the collected food, debris and other contaminants contained in the temporary collection receptacle 96 tends to roll or fall, due to gravity, and is transferred from the temporary collection receptacle 96 into the storage bin 108 via the transfer ramp of the pivotal door 214. If necessary, an operator may use the mop to facilitate complete transfer and/or clean the temporary collection receptacle 96 prior to lowering the temporary collection receptacle 96 back into position. Once all of the collected food, debris and other contaminants are removed from the temporary collection receptacle 96, the free end 138 of the actuation lever 212 is rotated as can be seen by the arrow in FIG. 9, about the fixed pivot 124 to lower to the dust pan 90 back into its in use position so that the leading edge 126 of the inclined ramp is again located closely adjacent, e.g., preferably abutting with, the surface to be cleaned S and thereafter facilitate receiving additional food, debris and other contaminants to be collected.

To facilitate raising and lowering of the dust pan 90, the opposite end 118 of the actuation lever 212 includes first and second linkage arms 128, 130. A first end of a first linkage arm 128 is pivotally connected to the opposite end 118 of the actuation lever while a second opposed end of the first arm 128 is pivotally connected to an intermediate portion of the dust pan 90. A first end of the second linkage arm is also pivotally connected to the opposite end 118 of the actuation lever while a second end of the second linkage arm 130 is pivotally connected with an elongate guide slot 132. The elongate guide slot 132 extends substantially perpendicular to a surface supporting the dispensing/collection system 28 typically along the entire length of the storage bin 108. The elongate guide slot 132 is typically formed in a plate 134 which is fastened to a side of the storage bin 108.

The opposite end 118 of the actuation lever 212 includes a play slot 136, i.e., having a length of a ½ inch to a couple of inches or so, and the first ends of the first and second linkage arms 128, 130 are pivotally connected to this play slot 136 by a nut and bolt, for example. Such connection allows relative movement of those two ends of the first and second linkage arms 128, 130 with respect to the actuation lever 212, during the raising and lowering movement of the dust pan 90 is elevated by the actuation lever 212 and as the dust pan 90 is returned to its in use position.

It is to be appreciated that the temporary collection receptacle 96 has a somewhat smaller capacity or volume while the storage bin 108 has a much larger capacity or volume in order to facilitate collection of a number of spills by the dispensing/collection system 28 before the dispensing/collection system 28 is returned to a service area for emptying and/or cleaning.

During lowering of the dust pan 90 back to its in collection position, as the operator commences pivoting the actuation lever 212 about the fixed pivot 124, i.e., commences rotation of the free end 138 of the actuation lever 212 from the position shown in FIG. 9, the pivotal door 214 is first closed due to the abutting engagement between a rear surface of the pivotal door 214 and a top surface of the storage bin 108—the rear surface of the pivotal door 214 is normally resting on the top surface of the storage bin 108 when in its open transfer position. Once the dust pan 90 is sufficiently lowered so that the pivotal door 214 is completely closed, the dust pan 90 then continues its further lowering motion until it reaches the position shown in FIG. 8. During such lowering movement, the guide slot 132 guides the dust pan 90 toward back to in collection position while maintaining the dust pan 90 in close abutting proximity to the storage bin 108 in order to maintained the pivotal door 214 in its closed vertically position due to the door's engagement with an adjacent exterior side wall of the storage bin 108. Once returned to the in use position of the dust pan 90, the guide slot 132 retains the dust pan 90 in close abutting proximity with the storage bin 108 so that the pivotal door 214 remains closed.

In the normal travel position of the dispensing/collection system 28, the leading edge 126 of the dust pan 90 is spaced a desired distance, e.g., one inch to three inches or so from the surface supporting the dispensing/collection system 28. As an operator approaches a spill on the floor, the operator will position the leading edge 126 of the dust pan 90 adjacent the spill and then will elevate a rear end 140 of the dispensing/collection system 28 by lifting the transverse handle 36 to bring the leading edge 126 of the dust pan 90 into contact with the floor as the dispensing/collection system 28 pivots slightly about the front pair of wheels 34. The operator will then rotate a conventional kick stand 142 from a stowed position to an in use position which will maintain the rear end 140 of the dispensing/collection system 28 in a slightly elevated or inclined position so that the leading edge 126 of the dust pan 90 is brought into engagement with the surface to be cleaned S. The kick stand 142 also acts as a brake to maintain the dispensing/collection system 28 in a substantially stable or fixed location while the operator cleans a spill on the surface to be cleaned S.

When cleaning a spill, the operator will normally first sweep, mop or otherwise force the solid waste materials of the spill up the inclined ramp 104 into the temporary collection receptacle 96. Once a substantial portion of the solid waste materials are transferred to the temporary collection receptacle 96, the operator will then use a squeegee to squeegee any remaining solid debris and particles as well as any liquid material of the spill up the inclined ramp 104 into the temporary collection receptacle 96. It is important to note that in order to facilitate transfer all of the liquid materials from the surface to be cleaned S onto the dust pan 90, there must be adequate and sufficient surface contact between the leading edge 126 of the dust pan 90 and the surface to be cleaned S. The slight inclination of the dispensing/collection system 28 as well as a conventional rubber strip 144 provided along the leading edge 126 of the dust pan 90 facilitate proper engagement. Once the major portion of the solid waste and/or liquid materials and debris are conveyed up the inclined ramp 104 of the dust pan 90 into the temporary collection area, the operator may then dispense a cleaning fluid or solution from the dispensing/collection system 28 onto the surface to be cleaned S to further rinse and clean the area of the surface containing the spill. Any applied cleaning fluid or solution is then also squeegeed up the inclined ramp into the temporary collection receptacle 96.

Once this spill has been adequately cleaned, the operator will again slightly raise the rear end 140 of the dispensing/collection system 28, by gentle lifting up on the handle 36 and thus slightly lifting and spacing the kick stand 142 from the surface supporting the dispensing/collection system 28. Once this has occurred, the operator then slightly lifts the rear end 140 of the dispensing/collection system 28, rotates or moves the kick stand 142 from its in use position to its stowed position and then gently lowers the rear end 140 of the dispensing/collection system 28 back onto the surface so that the second pair of wheels 35 are again brought into engagement with the surface. Such downward movement of the rear end 140 of the dispensing/collection system 28 will, in turn, sufficiently raise the leading edge 126 of the dust pan 90 so that it is brought out of engagement with the surface and the dispensing/collection system 28. Thereafter, the dispensing/collection system 28 may be then moved to another spill site or back to a storage closet or area until further use of the dispensing/collection system 28 is required. If desired, the kick stand 142 may have a latch or some other conventional and well known device for retaining the kick stand 142 in its stowed position.

A fluid collection/dispensing reservoir 146 is supported by the between the storage bin 108 and the handle 36. The fluid collection/dispensing reservoir 146 facilitates rinsing of the mop head and also facilitates applying any necessary cleaning fluid to the surface to be cleaned S. A conventional mop head rinsing bucket or container 148 is positioned directly above the fluid collection/dispensing reservoir 146. A bottom surface 150 of the rinsing container 152 is provided with a plurality of drainage openings to allow all of the liquid contained in the rinsing container 152 to be drained into a fluid chamber 154 located vertically beneath the rinsing container 152. The rinsing container 152 has a conventional squeezing device, not shown in detail, which when the mop head is accommodated within the rinsing container 152, squeezes the mop head to remove liquid thereform. A preferably a filter 156 is located between the drainage openings of the rinsing container 152 and an inlet of the fluid collection/dispensing reservoir 146 so that all of the fluid flowing from the rinsing container 152 into the fluid collection/dispensing reservoir 146 is filtered prior to entering therein.

An upper portion 158 of the rinsing container 152 includes a perimeter spray duct 160 which surrounds the entire top perimeter of the rinsing container 152. The perimeter spray duct 160 is provided with a plurality of inwardly directed spray apertures 162 or openings which facilitate spraying of cleaning fluid at the mop head when the mop head is located within the confines of the rinsing container 152. The perimeter spray duct 160 is connected to the fluid collection/dispensing reservoir 146 by a conventional hand pump 164. An inlet 166 of the hand pump 164 is connected to the fluid collection reservoir 146 via a supply conduit 168 while an outlet 170 of the hand pump 170 is connected to the perimeter spray duct 160. If desired, a soap or disinfectant dispensing apparatus device (not shown) can feed an adequate supply of the soap or disinfectant solution into the supply duct 168 adjacent an outlet of hand pump 164. The addition of soap or disinfectant to the cleaning fluid facilitates application of soap or some other cleansing disinfectant solution or fluid to the pumped fluid prior to the pumped fluid being sprayed by the perimeter spray duct 160 onto the mop head to be cleaned. During the operation, the operator will actuate the hand pump 164 by moving the lever 172 of the hand pump 164 to and fro, much like pumping water from a well, to pump fluid from the fluid collection/dispensing reservoir 146. Such actuation of the lever 172 will induce the hand pump 164 to syphon or suck fluid from the fluid collection/dispensing reservoir 146 along the supply conduit 168 and dispense the pumped fluid out through the perimeter openings 162 of the perimeter spray duct 160 radially inwardly against an exterior surface of the mop head to be cleaned. Once a sufficient supply of fluid is pumped or supplied to the mop head, the operator will then actuate the lever 174 of the rinsing container 152 to squeeze and remove a substantial portion of the rinsing fluid from the mop head and allow the rinsing fluid to drain, via gravity, down through the filter 156 and back into the fluid collection/dispensing reservoir 146. In the event that the mop head is not sufficiently clean after a single cleaning cycle, the operator can then actuate the hand pump 164 by operating the lever 172 to pump and dispense additional rinsing fluid at the mop head and the additional rinsing fluid will then be removed from the mop head by actuation of the lever 174. The rinsing procedure is repeated, as necessary, until the operator determines that the mop head is sufficiently cleaned for the next cleaning chore.

Figure 11:
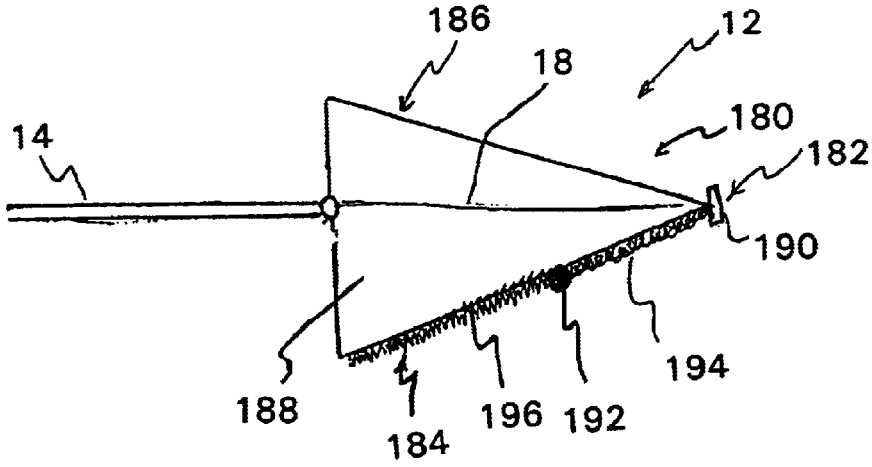
FIG. 11 is a diagrammatic cross sectional view of a mop head with the mop handle structure to form the mopping assembly according to the present invention.

With reference now to FIG. 11, another embodiment for a mop head 180 will now be described. As with the first embodiment the mopping assembly 12 comprises a handle 14 with a handle grip (not shown) at a remote free end of the handle 14 and a mop head 180 is located at the opposite end of the handle 14. The mop head 180, according to this embodiment, is a wedge shaped, i.e., has a generally triangular transverse cross section. If desired, a plurality of rigid support fingers 18 may be embedded within the mop head 180 to provide rigidity to the mop head 180 during the cleaning stroke. Each one of the support fingers 18 has one end thereof connected to the handle 14 while the opposite end of each one of the support fingers 18 extends along a longitudinal axis of the mopping assembly 12 toward a tip 182 of the wedge shaped mop head 180.

The mop head 180 comprises a first surface 184 and an opposed second surface 186, with each surface supporting at least one of an absorbent material and/or a non-absorbent material 188. The first surface 184 and second surface 186 form an angle therebetween and the formed angle between the first and second surfaces 184, 186 is between about 15 and 90 degrees, more preferably between about 25 and 50 degrees. The angle is generally selected such that an operator can be holding the handle 14 and cleaning with the mop head 180 while one of the first and second surfaces 184, 186 is generally lying flat on the surface to be cleaned S. The width of each of the first and second surfaces 184, 186 is between about a few inches and 36 inches or so, more preferably between about 6 and 24 inches or so. The length of each of the first and second surfaces 184, 186 are between 3 inches and 30 inches, and preferably between 2 inches and 15 inches or so. The wedge shape mop head 180 facilitates application of desired pressure to a desired surface to be cleaned S while using only normal mopping motion or stroke, as described below.

The first surface 184 of the mop head 180 can comprise a single textured surface or a number of different textured surfaces. According to a first embodiment of the wedge shaped mop head 180, the tip 182 of the wedge shaped mop head 180 has a squeegee 190 attached thereto. The squeegee 190 extends the entire width of the wedge shaped mop head 180 and lies in a plane extending normal to the longitudinal axis of the mop head. The squeegee extends from the first surface 184 by a distance of between 0.15 inches and 1 inch, and preferably between 0.2 inches and 0.5 inches or so.

An elongate pivot protrusion 192 is provided on the first surface 184 and this pivot protrusion 192 also extends normal to the longitudinal axis of the mop head. The pivot portion 192 is sufficiently sized and/or dimensioned and generally has a curved transverse profile to facilitate pivoting of the wedge shaped mop head 180, e.g., it projects from the first surface by a distance of between 0.1 inches and 2 inches, and preferably between 0.25 inches and 1 inch or so, so that the leading portion of the first surface 184, during a forward stroke to the wedge shaped mop head 180, is pivoted, about the pivot protrusion 192, into contact with the surface to be cleaned S while the trailing portion of the wedge shaped mop head 180 is simultaneously pivoted into a spaced relationship with respect to the surface to be cleaned S. During a return stroke of the wedge shaped mop head 180, the wedge shaped mop head 180 again pivots about the pivot protrusion 192 so that the trailing portion of the first surface 184, is pivoted into contact with the surface to be cleaned S, while the leading portion of the wedge shaped mop head 180 is simultaneously pivoted into a spaced relationship with respect to the surface to be cleaned S. The pivoting portion 192 may be manufactured from plastic, rubber or some other polymeric material, is typically semi-cylindrical in shape or some other type of lip and would extend the width of the wedge shaped mop head 180.

An abrasive portion 194 is provided between the squeegee 190 and a pivot protrusion 192. This abrasive portion 194 generally extends the entire width of the wedge shaped mop head 180 and has a length of between 1.5 inches and 20 inches, and preferably between 2 inches and 9 inches or so. This abrasive portion 194 can be manufactured from a variety of conventional materials which have varying degrees of abrasiveness. The abrasive portion 194 of the mop head 180 applies the scrubbing action to the surface to be cleaned S during the forward stroke of the wedge shaped mop head 180.

An absorbent portion 196 is provided between the pivot protrusion 192 and the handle 14. This absorbent portion 196 generally extends the entire width of the wedge shaped mop head 180 and has a length of between 1.5 inches and 20 inches, and preferably between 2 inches and 9 inches or so. This absorbent portion 196 can be manufactured from a variety of conventional absorbent materials and/or super absorbent polymers which have varying degrees of absorptiveness. The absorbent portion 196 of the mop head 180 facilitates fluid removal and/or drying to the surface to be cleaned S during the return stroke of the wedge shaped mop head 180. It is also possible for the wedge shaped mop head 180 to have one or more additional squeegees or wiping members, extending transverse of the longitudinal axis of the wedge shaped mop head 180 to apply additional wiping or drying to the surface to be cleaned S during a cleaning stroke.

The entire exposed second surface 186 of the wedge shaped mop head 180 may comprise, for example, either an absorbent material or an abrasive material. In this embodiment, the second surface 186 is an absorbent material. The absorbent material of the second surface 186, when engaged with to the surface to be cleaned S and wiped or mopped across there across, facilitates wiping or drying to the surface to be cleaned S.

Figure 12:
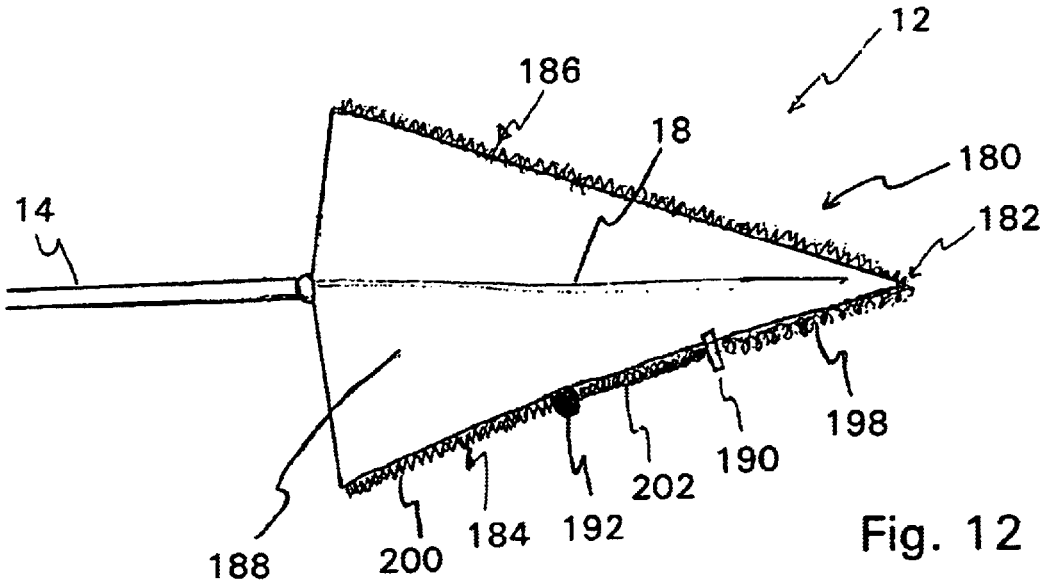
FIG. 12 is a diagrammatic cross sectional view of another mop head with the mop handle structure to form the mopping assembly according to the present invention.

With reference now to FIG. 12, another embodiment of the wedge shaped mop head 180 will be discussed. A first abrasive portion 198 is placed on the first surface 184 adjacent the tip 182 of the wedge shaped mop head 180. This first abrasive portion 198 generally extends the entire width of the wedge shaped mop head 180 and has a length of between 1.5 inches and 20 inches, and preferably between 2 inches and 9 inches or so. The first abrasive portion 198 can be can be manufactured from a variety of conventional materials which have varying degrees of abrasiveness. The first abrasive portion 198 of the mop head 180 applies the scrubbing action to the surface to be cleaned S during the forward stroke of the wedge shaped mop head 180.

An absorbent portion 200 is provided along the opposite edge of the first surface of the wedge shaped mop head 180. This absorbent portion 200 generally extends the entire width of the wedge shaped mop head 180 and has a length of between 1.5 inches and 20 inches, and preferably between 2 inches and 9 inches or so. This absorbent portion 200 can be manufactured from a variety of conventional absorbent materials and/or super absorbent polymers which have varying degrees of absorptiveness. The absorbent portion 200 of the mop head 180 facilitates fluid removal and/or drying to the surface to be cleaned S during the return stroke of the wedge shaped mop head 180.

An elongate pivot protrusion 192, extending normal to the longitudinal axis of the mop head, is provided on the first surface 184 between the absorbent portion 200 and the first abrasive portion 194 but immediately adjacent the absorbent portion 200. The pivot portion 192 is sufficiently sized and/or dimensioned and generally has a curved transverse profile to facilitate pivoting of the wedge shaped mop head 180.

A second abrasive portion is placed on the first surface 202, between the pivot protrusion 192 and the first abrasive portion 198. The second abrasive portion 202 generally extends the entire width of the wedge shaped mop head 180 and has a length of between 1.5 inches and 20 inches, and preferably between 2 inches and 9 inches or so. The second abrasive portion 202 can be manufactured from a variety of conventional materials which have varying degrees of abrasiveness. The second abrasive portion 202 of the mop head 180 applies the second scrubbing action to the surface to be cleaned S during the forward stroke of the wedge shaped mop head 180, i.e. the scrubbing action of the second abrasive portion 202 may be greater than or less than, depending upon the application, the scrubbing action of the first abrasive portion 198.

A squeegee 190 is located between and separates the first abrasive portion 198 from the second abrasive portion 202. The squeegee 190 extends the entire width of the wedge shaped mop head 180 and lies in a plane extending normal to the longitudinal axis of the mop head. The squeegee extends from the first surface 184 by a distance of between 0.15 inches and 1 inch, and preferably between 0.2 inches and 0.5 inches or so.

The entire exposed second surface 186 of the wedge shaped mop head 180 may comprise, for example, either an absorbent material or an abrasive material. In this embodiment, the second surface 186 is an absorbent material. The absorbent material of the second surface 186, when engaged with to the surface to be cleaned S and wiped or mopped across there across, facilitates wiping or drying to the surface to be cleaned S.

The pivot portion 192 is sufficiently sized and/or dimensioned and generally has a curved transverse profile to facilitate pivoting of the wedge shaped mop head 180 so that the leading portion of the first surface 184, during a forward stroke to the wedge shaped mop head 180, is pivoted, about the pivot protrusion 192, into contact with the surface to be cleaned S while the trailing portion of the wedge shaped mop head 180 is simultaneously pivoted into a spaced relationship with respect to the surface to be cleaned S. During a return stroke of the wedge shaped mop head 180, the wedge shaped mop head 180 again pivots about the pivot protrusion 192 so that the trailing portion of the first surface 184, is pivoted into contact with the surface to be cleaned S, while the leading portion of the wedge shaped mop head 180 is simultaneously pivoted into a spaced relationship with respect to the surface to be cleaned S.

Figure 13:
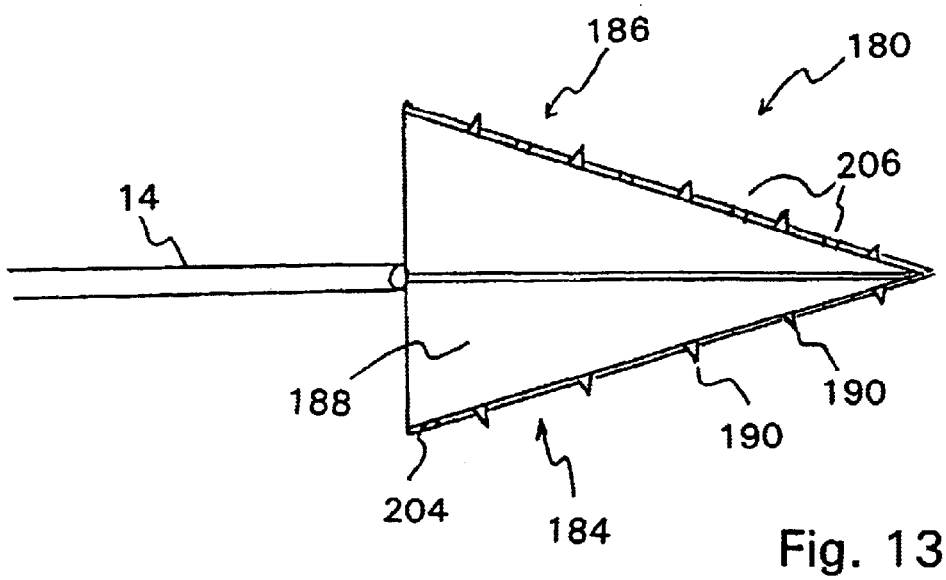
FIG. 13 is a diagrammatic cross sectional view of yet another a mop head with the mop handle structure to form the mopping assembly according to the present invention.

Turning now to FIG. 13, a further embodiment of the will now be discussed. According to this embodiment, the wedge shaped mop head 180 is primarily manufactured from an absorbent material and both of the first and the second surfaces 184, 186 have a plurality of transversely extending squeegees 190 formed therein. The squeegees 190 generally extend the fully width of the wedge shaped mop head 180 and are separated from one another by a distance of between 0.5 inches and 4 inches. A very thin layer of a porous non-absorbent material, e.g., between about 0.5 inches and 0.25 inches or so, are located between the squeegees 190 and space the remainder of the first or second surfaces 184, 186 from the surface to be cleaned S. If the porous non-absorbent material is not sufficiently porous, it may include a plurality of slots, openings, channels, apertures, etc., therein to facilitate passage of any collected fluid therethough into the absorbent material of the wedge shaped mop head 180. The squeegees 190 facilitate collection and pooling of liquid, as wedge shaped mop head 180 is mopped across a surface to be cleaned S, while the porous non-absorbent material facilitate transfer of the collected fluid into the absorbent material of the wedge shaped mop head 180. The collected fluid is then removed from the absorbent material of the wedge shaped mop head 180 by a wringing process.

It is understood that the squeegee 190, abrasive portion 194, 198, 192 and the wiper portion 196, 184 of first surface 184 of the mop head 180 can be arranged in a different combination depending on the desired application. Also the second surface 186 of the mop head 180 may accommodate a working portion other than a wiping portion such as a mild abrasive portion.

Since certain changes may be made in the above described improved dispensing/collection system and mopping assembly, without departing from the spirit and scope of the invention herein involved, it is intended that all of the subject matter of the above description or shown in the accompanying drawings shall be interpreted merely as examples illustrating the inventive concept herein and shall not be construed as limiting the invention.

I claim:

1. A cleaning system for facilitating cleaning of a desired surface, the cleaning system comprising:

a base framework supporting a dust pan comprising a ramp area located adjacent a temporary collection receptacle, and including a pivotal door to facilitate transfer of collected debris;

the base framework also supporting a storage bin located adjacent the temporary collection receptacle;

an actuation lever being connected to the base framework and operatively coupled to the dust pan to facilitate movement of the dust pan and transfer of any debris, temporarily stored in the temporary collection receptacle, to the storage bin once the pivotal door of the temporary collection receptacle opens.

2. The cleaning system according to claim 1, wherein the pivotal door is pivotally connected to of the temporary collection receptacle so that once the actuation lever has pivoted the dust pan a sufficient distance above the storage bin, the pivoted door is allowed to gradually pivots, about its pivotal connection in to an open position where the pivotal door forms a transfer ramp for transferring the debris from the temporary collection receptacle into the storage bin.

3. The cleaning system according to claim 1, in combination with a wedge shaped mop head, and the wedge shaped mop head comprises a first surface and an opposed second surface with each surface supporting at least one of an absorbent material and a non-absorbent material.

4. The cleaning system according to claim 3 in combination with the wedge shaped mop head, wherein at least one of the first and the second surfaces has an elongate pivot protrusion which extends normal to a longitudinal axis of the mop head, and the pivot portion is sufficiently sized to facilitate pivoting of the wedge shaped mop head so that a leading portion of the first surface contacts the surface to be cleaned, during a forward stroke to the wedge shaped mop head, while a trailing portion of the wedge shaped mop head contacts the surface to be cleaned during a return stroke of the wedge shaped mop head.

5. The cleaning system according to claim 3 in combination with the wedge shaped mop head, wherein at least one of the first and the second surfaces of the wedge shaped mop head has at least one of a squeegee, an absorbent material and a non-absorbent material.

6. A cleaning system for facilitating cleaning of a desired surface, the cleaning system comprising:

a base framework supporting a dust pan comprising a ramp area located adjacent a temporary collection receptacle, and including a pivotal door to facilitate transfer of collected debris;

the base framework also supporting a storage bin located adjacent the temporary collection receptacle;

an actuation lever being connected to the base framework and operatively coupled to the dust pan to facilitate movement of the dust pan and transfer of any debris, temporarily stored in the temporary collection receptacle, to the storage bin once the pivotal door of the temporary collection receptacle opens, the actuation lever includes first and second linkage arms, a first end of the first linkage arm is pivotally connected to a first end of the actuation lever while a second opposed end of the first arm is pivotally connected to an intermediate portion of the dust pan, a first end of the second linkage arm is also pivotally connected to the first end of the actuation lever while a second end of the second linkage arm is pivotally connected with an elongate guide slot supported by the base framework, and the first and second linkage arms and the guide slot guide the dust pan during raising and lowering movement of the dust pan by the actuation lever.

7. The cleaning system according to claim 6, wherein the base framework supports a fluid dispensing container and a fluid collection container; a wringing mechanism is supported by the base framework, the manual wringing system is coupled to the fluid dispensing container to receive a cleaning fluid therefrom to facilitate cleaning of a mopping assembly when located within the wringing mechanism, and the wringing mechanism is coupled to the fluid collection container to convey collected fluid from the wringing mechanism to the collection container; and a filter is located, between the wringing mechanism and the collection container, to filter the fluid wrung from the mopping assembly prior to discharging the wrung fluid in the collection container.

8. The cleaning system according to claim 7, wherein the cleaning system includes a framework which supports both the collection container and the dispensing container, and the framework facilitates changing, when the collection container is substantially full of collected fluid, a position of the collection container and the dispensing container.

9. The cleaning system according to claim 8 in combination with a mopping assembly comprising an elongate handle with a had grip at one end and the cleaning pad located at the opposite end thereof, the cleaning pad comprising both a non-absorbent material and an absorbent material, and the absorbent material facilitates removing dirt and debris from the surface to be cleaned while the non-absorbent material facilitates removing absorbed liquid and debris from the cleaning pad during wringing of the cleaning pad.

10. The cleaning system according to claim 9 in combination with the mopping assembly, wherein the cleaning pad has a plurality of drainage channels formed therein, and the draining channels are at least partially defined by the non-absorbent material.

11. The cleaning system according to claim 10 in combination with the mopping assembly, wherein the end of the elongate handle, supporting the cleaning pad, has a T-shaped head which supports a plurality of support fingers, and the plurality of support fingers rigidly support the cleaning pad during use of the mopping assembly.

12. The cleaning system according to claim 11 in combination with the mopping assembly, wherein the absorbent material engages with the plurality of support fingers to facilitate cleaning of a desired surface while the non-absorbent material overlies a space located between two adjacent support fingers, and the plurality of support fingers and the non-absorbent material define a plurality of drainage channels which facilitate removal of liquid and debris from the cleaning pad during a rinse procedure.

13. The cleaning system according to claim 7, wherein a supply conduit couples the dispensing container with the wringing mechanism and a dispensing conduit couples the wringing mechanism with the collection container, and a flow valve controls the flow of fluid from the dispensing container with the wringing mechanism during the wringing procedure.

14. The cleaning system according to claim 7, wherein the base framework is supported on wheels and a handle is coupled to the base framework to facilitate manipulation of the cleaning system.

15. The cleaning system according to claim 14, wherein a supply conduit connects the collection container with the wringing mechanism and a drainage conduit connects the wringing mechanism with the collection container, and valve is located in the supply conduit to control the flow of fluid from the dispensing container to the wringing mechanism.

16. The cleaning system according to claim 15, wherein the valve is coupled to a remotely controlled actuation lever to facilitate remote actuation of the valve when desired.

17. The cleaning system according to claim 7, wherein a releasable latching mechanism is supported by the base framework and the releasable latching mechanism, when engaged with the framework, prevents relative movement between a central framework and the base framework, and, when the releasable latching mechanism is disengaged from the central framework, the releasable latching mechanism permits relative rotation of the central framework with respect to the base framework.

18. The cleaning system according to claim 7, wherein a releasable latching mechanism is supported by at least one of the dispensing container and the collection container, and the releasable latching mechanism, when engaged with the framework, prevents relative movement between a central framework and the base framework, and when the releasable latching mechanism is disengaged from the central framework, permits relative movement of the central framework with respect to the base framework.

19. The cleaning system according to claim 7, wherein a wringing mechanism includes a perforated plate and the filter is located in a separation chamber, and the filter separates the separation chamber into an upper chamber and a lower chamber, and lower chamber communicates with a drainage conduit.

20. A method of facilitating cleaning of a desired surface, the method comprising the steps of:

supporting a dust pan, comprising a ramp area located adjacent a temporary collection receptacle, on a base framework, and providing the dust pan with a pivotal door to facilitate transfer of collected debris;

supporting a storage bin, located adjacent the temporary collection receptacle, on the base framework;

connecting an actuation lever to the base framework and operatively coupling the actuation lever to the dust pan to facilitate movement of the dust pan and transfer of any debris, temporarily stored in the temporary collection receptacle, to the storage bin once the pivotal door of the temporary collection receptacle opens in combination with an elongate handle with a hand grip at one end and a cleaning pad located at the opposite end thereof, the cleaning pad comprising both a non-absorbent material and an absorbent material, and the absorbent material facilitates removing dirt and debris from the surface to be cleaned while the non-absorbent material facilitates removing absorbed liquid and debris from the cleaning pad during wringing of the cleaning pad.

* * * * *